US008844781B2

(12) United States Patent
Rose et al.

(10) Patent No.: US 8,844,781 B2
(45) **Date of Patent: *Sep. 30, 2014**

(54) ADJUSTABLE POSITIONING MECHANISM AND A BAG OR PACK, SUCH AS A BACKPACK OR OTHER ARTICLE, HAVING SUCH MECHANISM

(75) Inventors: Gordon Rose, North Vancouver (CA); Daniel Allan Green, Okotoks (CA); Michael Douglas Blenkarn, North Vancouver (CA); Jason Berns, East Aurora, NY (US)

(73) Assignee: Arc'Teryx Equipment Inc., North Vancouver, B.C. (CA)

( * ) Notice: Subject to any disclaimer, the term of this patent is extended or adjusted under 35 U.S.C. 154(b) by 955 days.

This patent is subject to a terminal disclaimer.

(21) Appl. No.: 11/779,636

(22) Filed: Jul. 18, 2007

(65) Prior Publication Data

US 2008/0041906 A1 Feb. 21, 2008

Related U.S. Application Data

(60) Provisional application No. 60/831,731, filed on Jul. 19, 2006.

(51) Int. Cl.

| | |
|---|---|
| ***A45F 3/08*** | (2006.01) |
| ***A45F 3/04*** | (2006.01) |
| ***A45C 13/30*** | (2006.01) |
| *A45F 3/02* | (2006.01) |

(52) U.S. Cl.

CPC ..... *A45F 3/047* (2013.01); *A45F 2003/025* (2013.01); *A45F 3/08* (2013.01); *A45C 13/30* (2013.01)

USPC ..... 224/631; 224/628; 224/633

(58) Field of Classification Search

USPC ..... 224/578, 579, 631, 627, 628, 630, 637; 248/221.12

See application file for complete search history.

(56) References Cited

U.S. PATENT DOCUMENTS 2,548,993 A * 4/1951 Mierzwa ..... 410/101
4,356,942 A * 11/1982 Hayes ..... 224/630

(Continued)

FOREIGN PATENT DOCUMENTS

DE 36 05 532 A1 8/1987
DE 38 03 026 A1 9/1988

(Continued)

*Primary Examiner* — Justin Larson

(74) *Attorney, Agent, or Firm* — Greenblum & Bernstein, P.L.C.

(57) ABSTRACT

An adjustable positioning mechanism, such as for positioning ends of straps or handles of bag or packs, such as for backpacks, but also, more generally, for removably connecting an item to an article to be carried to provide a range of attachment locations for the item relative to the article, to achieve an optimum ergonomic position of the item at one of the attachment locations. One element of the adjustment mechanism can be either adhesively bonded to the article or made in one piece with a frame of the article, the item to be attached bearing a second element of the mechanism. Embodied as part of a bag or pack, the invention can include a carrying system directly or indirectly connected to the pack portion and include at least one carrying element, and an adjustment mechanism to provide a range of attachment locations on the pack portion for a carrying member of the carrying system, such as one or more shoulder straps, such adjustment mechanism including at least one element that is bonded to the backpack. In a particular embodiment, the backpack includes a frame connected to the back side of the pack portion, the frame including at least a rigid or semi-rigid sheet frame which is affixed to the back side of the pack portion by adhesive bonding. The element(s) of the adjustment mechanism are bonded to the backpack against the area at which the frame is mounted.

55 Claims, 16 Drawing Sheets

(56) References Cited

U.S. PATENT DOCUMENTS

| | | | | | |
|---|---|---|---|---|---|
| 4,420,103 | A | * | 12/1983 | Douglass | 224/630 |
| 4,750,654 | A | * | 6/1988 | Menetrier | 224/630 |
| 4,783,034 | A | * | 11/1988 | Ostrander et al. | 248/221.12 |
| 4,842,173 | A | | 6/1989 | Scherer | |
| 4,920,575 | A | | 5/1990 | Bartasis et al. | |
| 5,005,744 | A | | 4/1991 | Gleason | |
| 5,209,384 | A | * | 5/1993 | Anderson | 224/580 |
| 5,240,159 | A | | 8/1993 | Gregory | |
| 5,361,955 | A | * | 11/1994 | Gregory | 224/630 |
| 5,487,498 | A | | 1/1996 | Gleason | |
| 5,564,612 | A | | 10/1996 | Gregory | |
| 5,725,139 | A | | 3/1998 | Smith | |
| 5,762,251 | A | | 6/1998 | Gleason | |
| 5,836,489 | A | * | 11/1998 | Swetish | 224/262 |
| 5,890,640 | A | | 4/1999 | Thompson | |
| 5,904,282 | A | | 5/1999 | Gleason | |
| 5,954,253 | A | * | 9/1999 | Swetish | 224/631 |
| 5,961,019 | A | | 10/1999 | Gleason | |
| 5,975,387 | A | | 11/1999 | Gleason et al. | |
| 5,984,157 | A | * | 11/1999 | Swetish | 224/631 |
| 6,029,875 | A | * | 2/2000 | Johnston | 224/417 |
| D426,700 | S | | 6/2000 | Gregory | |
| 6,154,935 | A | | 12/2000 | Gregory et al. | |
| 6,179,188 | B1 | | 1/2001 | Gleason | |
| 6,321,959 | B1 | | 11/2001 | Howell | |
| 6,325,262 | B1 | | 12/2001 | Thompson | |
| 6,375,053 | B1 | | 4/2002 | Cecchinel | |
| 6,460,746 | B1 | | 10/2002 | Amram | |
| 6,607,107 | B2 | | 8/2003 | Dexheimer | |
| 6,626,342 | B1 | | 9/2003 | Gleason | |
| 6,634,533 | B2 | | 10/2003 | Thompson et al. | |
| 6,802,442 | B1 | | 10/2004 | Thompson | |
| 7,484,275 | B2 | | 2/2009 | Carroll et al. | |
| 2006/0060625 | A1 | * | 3/2006 | Kuder et al. | 224/637 |
| 2006/0283907 | A1 | | 12/2006 | Green et al. | |

FOREIGN PATENT DOCUMENTS

| | | | | |
|---|---|---|---|---|
| DE | 19803729 | A1 | * | 8/1999 |
| DE | 199 32 499 | A1 | | 2/2001 |
| EP | 1 625 807 | A2 | | 2/2006 |
| EP | 1 736 074 | A1 | | 12/2006 |
| EP | 1 880 630 | B1 | | 5/2012 |
| FR | 2 670 096 | A1 | | 6/1992 |
| FR | 2 878 701 | A1 | | 6/2006 |
| WO | WO-92/21265 | A1 | | 12/1992 |

* cited by examiner

Fig. 5
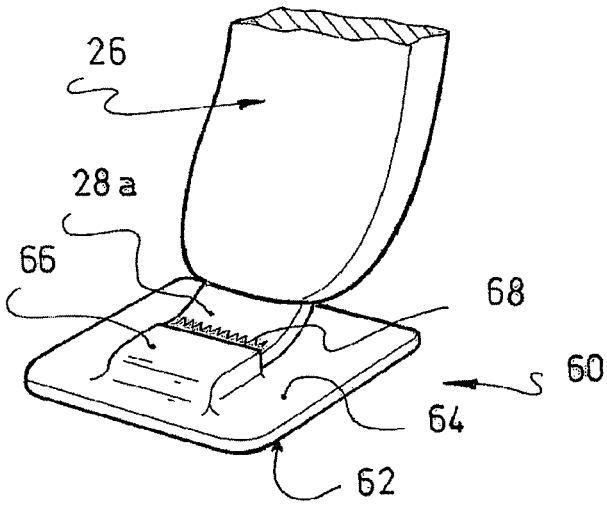
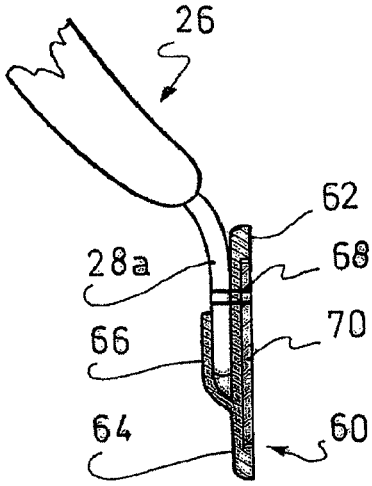
Fig. 6

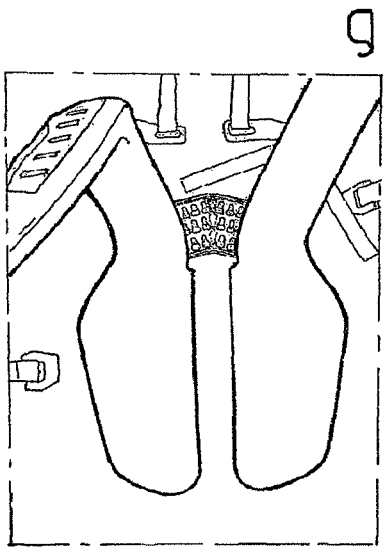
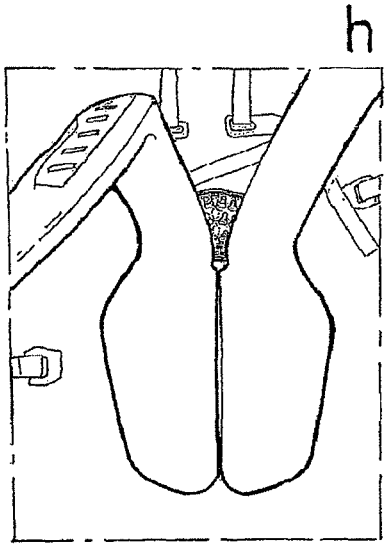
Fig: 16
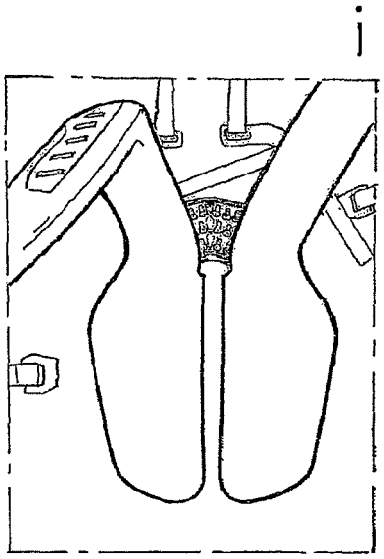

ADJUSTABLE POSITIONING MECHANISM AND A BAG OR PACK, SUCH AS A BACKPACK OR OTHER ARTICLE, HAVING SUCH MECHANISM

CROSS-REFERENCE TO RELATED APPLICATION

This application is based upon U.S. Patent Application No. 60/831,731, filed on Jul. 19, 2006, the disclosure of which is hereby incorporated-by-reference thereto in its entirety and the priority of which is claimed under 35 USC 119(e).

BACKGROUND OF THE INVENTION

1. Field of the Invention

The invention relates to an adjustable positioning mechanism, such as for positioning ends of straps or handles of bags or packs and, more particularly, backpacks, but also for adjustably positioning straps and harnesses of any article to be carried. In addition, the invention is directed to such bag, pack, backpacks, and/or harness, which incorporate such adjustable positioning mechanism.

2. Description of Background and Relevant Information

Backpacks typically comprise a pack portion, usually made of relatively flexible (i.e., non-rigid) materials such as panels of textile fabrics, which forms a compartment adapted to receive a load to be carried. The pack portion comprises a back side which is positioned opposite the back of the user when it is worn. The backpack also has a carrying system which can comprise a pair of shoulder straps and possibly a hip-belt.

Being made of flexible materials, a loaded backpack tends to deform due to the volume and/or the weight of the load inside the pack. In particular, the back side can deform, which is most uncomfortable to the user.

In order to prevent such unwanted deformation, at least partly, it is known to provide the backpack with a stiffening frame along its back side. Such frames may be of different kinds. Some packs are equipped with one or more rigid rods (or stays) which are inserted in gussets attached to the back side. These rods are usually made of metal, plastic, or composite material, and they run substantially vertically along the back side. Other packs have a frame made of a sheet of semi-rigid or rigid material which is inserted in a gusset pocket of corresponding shape attached to the back side (usually on the inner side of the back side). Such sheet frame can be made of various materials, including plastic, composite materials, or rigid or semi-rigid foams. In the latter case, it can be provided that the sheet frame of semi-rigid foam is made of a folded sheet which is removably inserted in the gusset pocket and which can be removed to be used as a sleeping mattress for outdoor sports enthusiasts.

A sheet frame can also be reinforced by removable or non-removable rigid rods, and it can also be complemented by a layer of soft foam to provide additional carrying comfort for the user.

In most backpacks having a hip-belt, the carrying system is made to shift at least part of the weight of the load off the shoulder straps, down to the hip-belt, in order that at least part of the weight of the load is carried by the hips of the user rather than having his/her shoulders and back carry all the load. The stiffening frame participates in that load transfer by making a link between the shoulder strap attachment portions of the pack portion and its hip-belt attachment portions.

Nevertheless, conventional backpacks having a stiffening frame share in common that the frame is not an integral part of the pack and that this introduces undesirable movements and deformations between the frame and the relatively flexible material of the back side.

U.S. Pat. No. 4,750,654 discloses a backpack in which the flexible pack portion has no back side, the back side of the backpack being made of layered structure comprising two layers of cellular synthetic resins (i.e., foams) over-molded on a fabric layer. The flexible pack portion is sewn onto the outer periphery of the back side structure.

Another problem with prior art backpacks is that most of them are not waterproof, not even water resistant. Waterproof bags are known in the art, such bags typically made of PVC-coated materials. Such waterproof bags are made by assembling panels by welding.

Welding is here opposed to gluing. Gluing requires the provision of an adhesive material between the two pieces to be assembled, whereas welding means that the surface of at least one of the pieces to be assembled (but preferably both) is melted to adhesively bond the two pieces. Both welding and gluing result in an adhesive bonding of the two pieces.

Welding operations are quite complicated as they require the use of complicated tools to press and heat the panels to be assembled along the necessary junction line. Such tools are even more complicated when it comes to welding along a non-straight line, and more complicated still when the junction line is three dimensional. On such PVC-coated bags, various handles and straps may be connected to the exterior surface of the bag. The technique used up to now has been to provide anchoring pads of plastic material, on which the handle or the strap is affixed, for example by sewing, and to weld the pads to the outer surface of the material.

Unfortunately, in some cases, the welding operation only permits welding along the periphery of the pad, not along its entire contacting surface. This is due to the presence of the strap or handle which is affixed to the pad, usually in the center of such pads, and which therefore makes it difficult to bring enough heat and pressure to the center of the pad to achieve welding.

Moreover, such bags have the undesirable feature of requiring PVC-coated or urethane-coated materials when it is now known that extensive use of PVC is undesirable in view of environmental issues. At least for this reason, urethane-coated waterproof bags are known in the prior art.

Backpacks are known to employ any of various mechanisms for adjusting the point of attachment of carrying members, such as shoulder straps, although the range of adjustment is limited by construction techniques that have heretofore been known. As an example, the document FR 2 670 096 discloses a device for adjusting the point of attachment of both shoulder straps, height-wise along the backpack, by utilizing a vertical strap on which horizontal loops are formed by stitching the strap onto the backpack, with an elongated removable rigid pin holding a junction end of both shoulder straps secured to a selected one of the loops. The position of a lower belt is similarly adjustably attached. Particular disadvantages with this adjustment mechanism include the limitation by which the shoulder straps of the backpack are not individually vertically adjustable, as well as the limitation by which the shoulder straps are not horizontally adjustable. In addition, the requirement of the rigid pin in the adjustment mechanism can present a problem should it become inadvertently detached and lost.

The document EP 1 625 807 provides an advance over the aforementioned adjustment mechanism in the sense that individual adjustment of the points of attachment of a pair of shoulder straps is provided by attaching to the backpack left and right adjustment strap formations to which respective ones of the two shoulder straps are adjustably secured at any of a plurality of vertically spaced-apart locations. A limited amount of variation in the width between the shoulder straps is provided by positioning the left and right adjustment strap formations of the adjustment mechanism in an upwardly extending divergent relationship. In spite of the improvements over the aforementioned adjustment mechanism of FR 2 670 096, this mechanism retains certain of the prior disadvantages. First, in addition to components that are carried by the shoulder straps and by the backpack, the adjustment mechanism relies upon separate rigid fasteners, here a U-shaped fastener preferably made of metal. Second, adjustment straps are stitched to the backpack. Third, although the divergent relationship of the left and right adjustment straps provide for a variation in the horizontal spacing of the shoulder straps, this horizontal spacing is limited by being achieved in conjunction with a higher positioning of the attachment location of the shoulder straps along the adjustment straps, i.e., the assumption being that a taller person will likely have wider shoulders as well as a longer torso. A more universal adjustment, such as to accommodate a shorter person with broader shoulders, and a taller person with narrower shoulders, is not possible.

U.S. Pat. No. 5,005,744 discloses another form of adjustable backpack. The back side of the backpack includes a stiffening but flexible planar element which is held in a pocket to provide a flexible pack frame. A second adjacent pocket is formed to receive the ends of a pair of shoulder straps, which are secured within the second pocket by means of respective Velcro® fastener portions. Although the lengths of the shoulder straps are thereby adjustable and the orientation of the straps can be individually adjusted, the height of the effective attachment of the straps to the backpack is not adjustable.

SUMMARY OF THE INVENTION

The invention is directed to an adjustable positioning mechanism, such as for positioning one or more ends, or end portions, of straps or handles of bags or packs, such as duffle bags, drybags, travelpacks, and, more particularly, backpacks, but also for adjustably positioning straps and harnesses of any article to be carried. In addition, the invention is directed to such bag, pack, backpacks, and/or harness, which incorporate such adjustable positioning mechanism. In addition, in addition to the adjustable positioning of strap ends, the invention is directed to a mechanism for adjustable positioning of auxiliary pockets, containers, and other items that can be adjustably attached to another item, such as a larger bag, pack, or backpack.

Examples of products encompassed by the invention, in addition to backpacks and, more generally, bags and packs, are golf bags, and power equipment, such as harnesses for carrying gas-powered landscaping equipment (such as blowers, edgers, trimmers, etc.), and any type of article that includes a strap or harness to enable the article to be carried by a person, particularly to be carried by the shoulders. Any of such articles can employ one carrying strap, as well as two or more straps.

In addition, the invention is directed to such articles, such as bags, packs, backpacks, and other articles to be carried by an adjustable strap or to be affixed, as an auxiliary item, to another article.

In any such embodiment, the invention is carried out by means of an improved structure and/or by means of construction techniques not heretofore known to those skilled in the art.

Such improved structure and construction techniques further allow for improvements in the attachment of load-carrying components, such as adjustment mechanisms for carrying members, such as shoulder straps or other components such as independently attached pockets and devices for holding tools or other equipment that a user might require or find convenient.

As an example, an article to be carried by a person includes:

an adjustable positioning mechanism for removably connecting an item to the article, the mechanism providing a range of attachment locations for the item relative to the article, to achieve an optimum ergonomic position of said item at one of the attachment locations, the adjustable positioning mechanism including:

- a first element affixed by adhesive bonding to either the article to be carried or to the item to be connected to the article, the first element comprising an array of first connector sites, such array providing longitudinal and transverse, or horizontal and vertical, adjustability;
- a second element including at least two second connector sites for selective releasable engagement with respective ones of the at least two first connector sites of the first element.

As an example of a bag or pack, such as a backpack according to the invention, such improved structure can include the following:

a pack portion including a back side made of flexible material;

a rigidifying frame connected to the pack portion to the back side of the pack portion by adhesive bonding;

a carrying system directly or indirectly connected to the pack portion and comprising at least one carrying member having at least two spaced-apart portions connected to respective spaced-apart portions of the pack portion, such as upper and lower portions of a shoulder strap of a backpack;

an adjustment mechanism for providing a range of adjustable attachment locations on the pack portion for the carrying member at at least one of said two spaced-apart portions of the pack portion, such as at an upper portion of a shoulder strap of a backpack;

the adjustment mechanism including a first element affixed at one of said two spaced-apart portions of the pack portion by adhesive bonding, i.e., by gluing or by welding, and a second element affixed to the carrying member.

According to a further feature, the frame comprises a rigid or semi-rigid frame affixed to the back side of the pack portion by adhesive bonding, i.e., whether by gluing or by welding.

The invention can be implemented with or without a rigidifying frame. If a frame is used, it can be internal or external of the bag/backpack, and the frame can be a frame sheet, produced, e.g., as an injection-molded part, with the aforementioned first element of the adjustment mechanism unitarily molded into the sheet. If the frame sheet is mounted internally of the backpack, an appropriate opening in the back of the backpack can be made for exposing the connector sites of the adjustment mechanism element. As an alternative to unitary molding, the first element could be adhesively bonded to the frame sheet.

According to a particular embodiment, the carrying member can be a shoulder strap and at least one of the spaced-apart portions of the pack portion is in a shoulder region.

According to a particular feature of an embodiment according to the invention, the first element includes a plurality of first connector sites and the second element includes plurality of second connector sites, the first connector sites being releasably engageable with the second connector sites for providing the aforementioned range of attachment locations for the carrying member by enabling selective connection of the second element of the adjustment mechanism to the first element of the adjustment mechanism in any of a plurality of different attachment locations of the carrying member relative to the pack portion of the backpack.

According to a further feature, at least one of the pluralities of first and second connector sites includes a plurality of connector sites that provides at least a plurality of connector sites that enable selective connection of the second element of the adjustment mechanism along a range of different horizontally and/or vertically spaced-apart attachment locations.

According to a further feature, the backpack includes a pair of shoulder straps, each shoulder strap including a respective second element of an adjustment mechanism for providing independent adjustment relative to the other shoulder strap.

According to a particular embodiment, the first element of the adjustment mechanism comprises a plastic plate, the plastic plate including an array of first connector sites, such array providing horizontal and vertical adjustability, and the second element of the adjustment mechanism includes at least two second connector sites for selective releasable engagement with a pair of the first connector sites of the first element of the adjustment mechanism.

Further, according to a particular embodiment, the plurality of first connector sites of the first element of the adjustment mechanism includes receptacles and the plurality of second connector sites of the second element of the adjustment mechanism includes projections which are releasably engageable with the receptacles. Alternatively, the plurality of first connector sites of the first element of the adjustment mechanism can include projections and the plurality of second connector sites of the second element of the adjustment mechanism includes receptacles which are releasably engageable with said projections.

More particularly, the receptacles can be keyhole-shaped receptacles and the projections can be button-headed projections. Still further, a receptacle of the keyhole-shaped receptacles includes an enlarged portion and a narrowed portion extending from the enlarged portion, whereas a button of the button-headed projections have a size and shape to be freely received and removed from the enlarged portion of the receptacle and to be retained beneath the narrowed portion of the receptacle.

Still further, in an embodiment in which the bag is a backpack and the carrying member comprises at least one shoulder strap, the narrowed portion of the receptacle extends upwardly in a direction toward a top of the backpack from the enlarged portion of the backpack.

According to a further particular embodiment, the plurality of first connector sites is greater in number than the plurality of second connector sites, whereby the carrying member can be moved from a first of the at least two spaced-apart connection locations to a second of the at least two spaced-apart connection locations by disengaging projections of the second element from receptacles of the first element at the first of the at least two spaced-apart connection locations and by engaging projections of the second element with receptacles of the first element at said second of the at least two spaced-apart connection locations.

Either or both of the first and second elements can be made as one plastic piece, such as by having been made by injection molding.

BRIEF DESCRIPTION OF THE DRAWINGS

Other aspects of the invention will be set forth in the following detailed specification which refers to the appended drawings in which:

FIG. 5 is a perspective back view showing the assembly of the upper end of a shoulder strap on the back side of the pack;

FIG. 6 is a vertical cut-out view along line VI-VI of FIG. 5;

Figure 8:
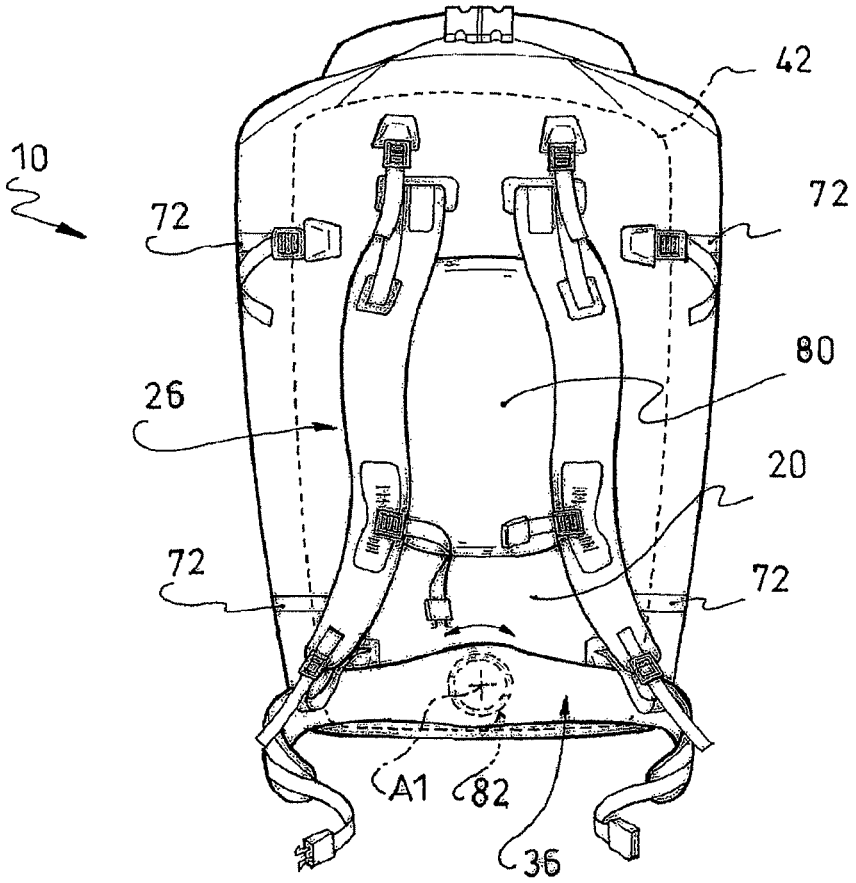
Figure 16:
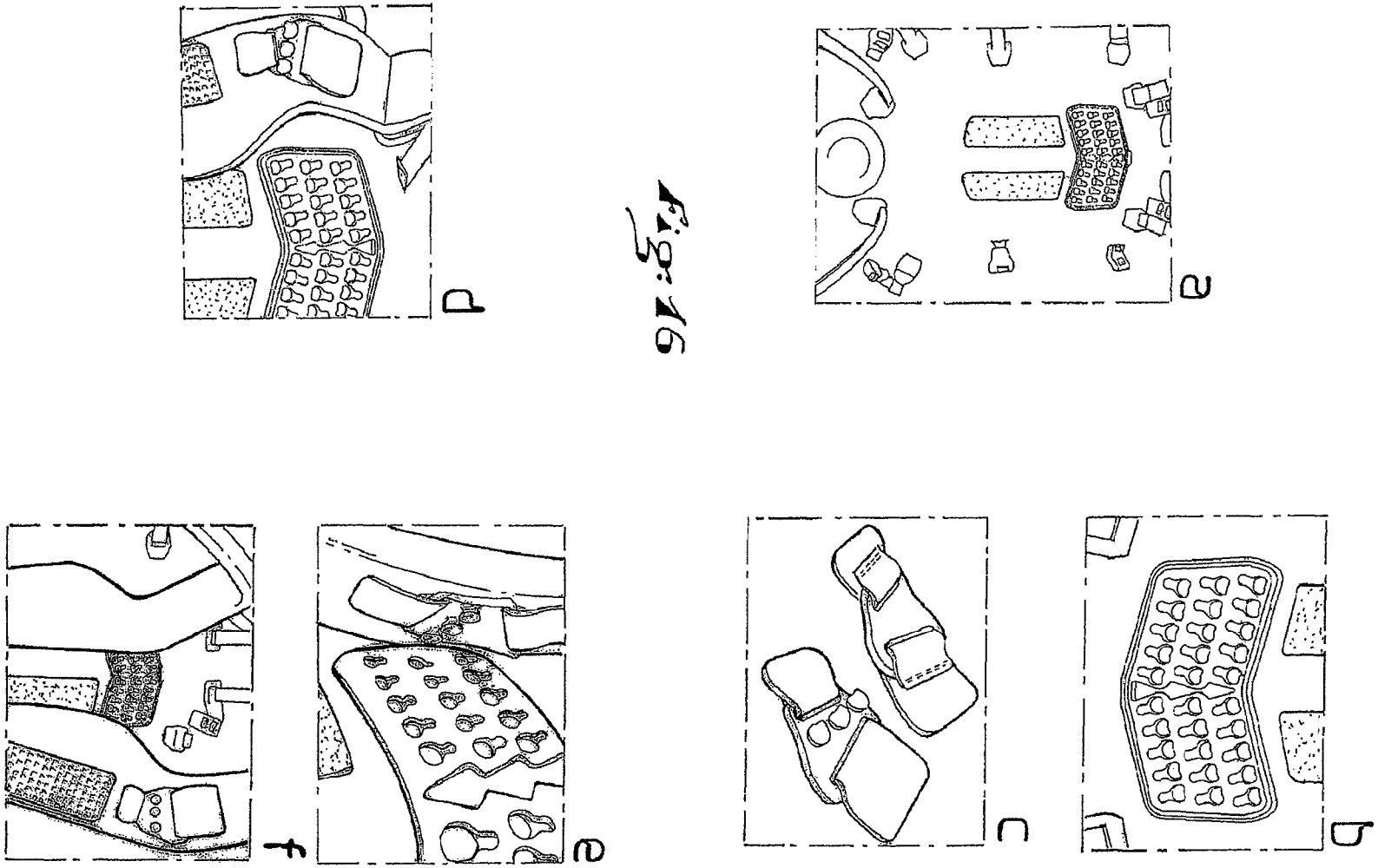
Figure 17:
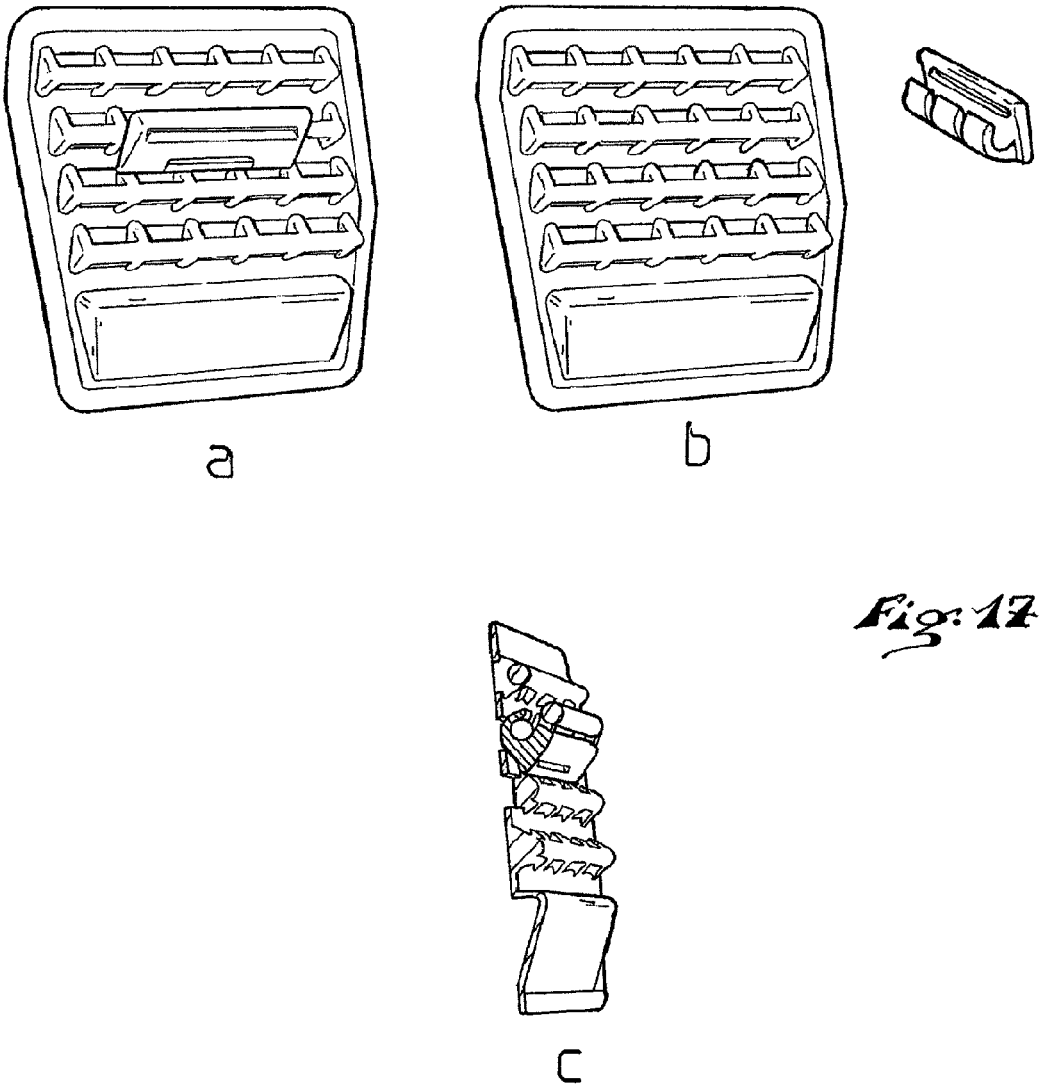
Figure 18:
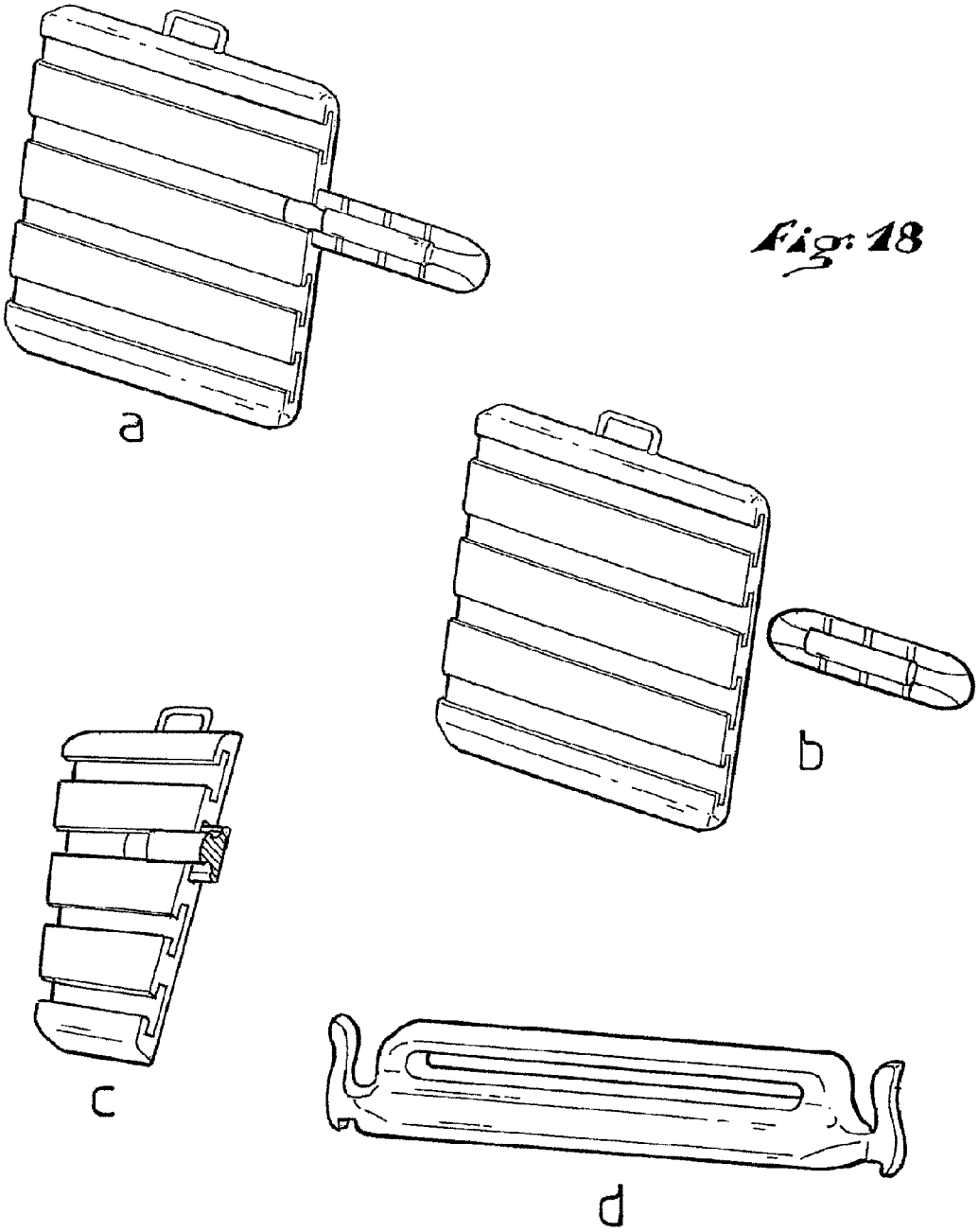
Figure 19:
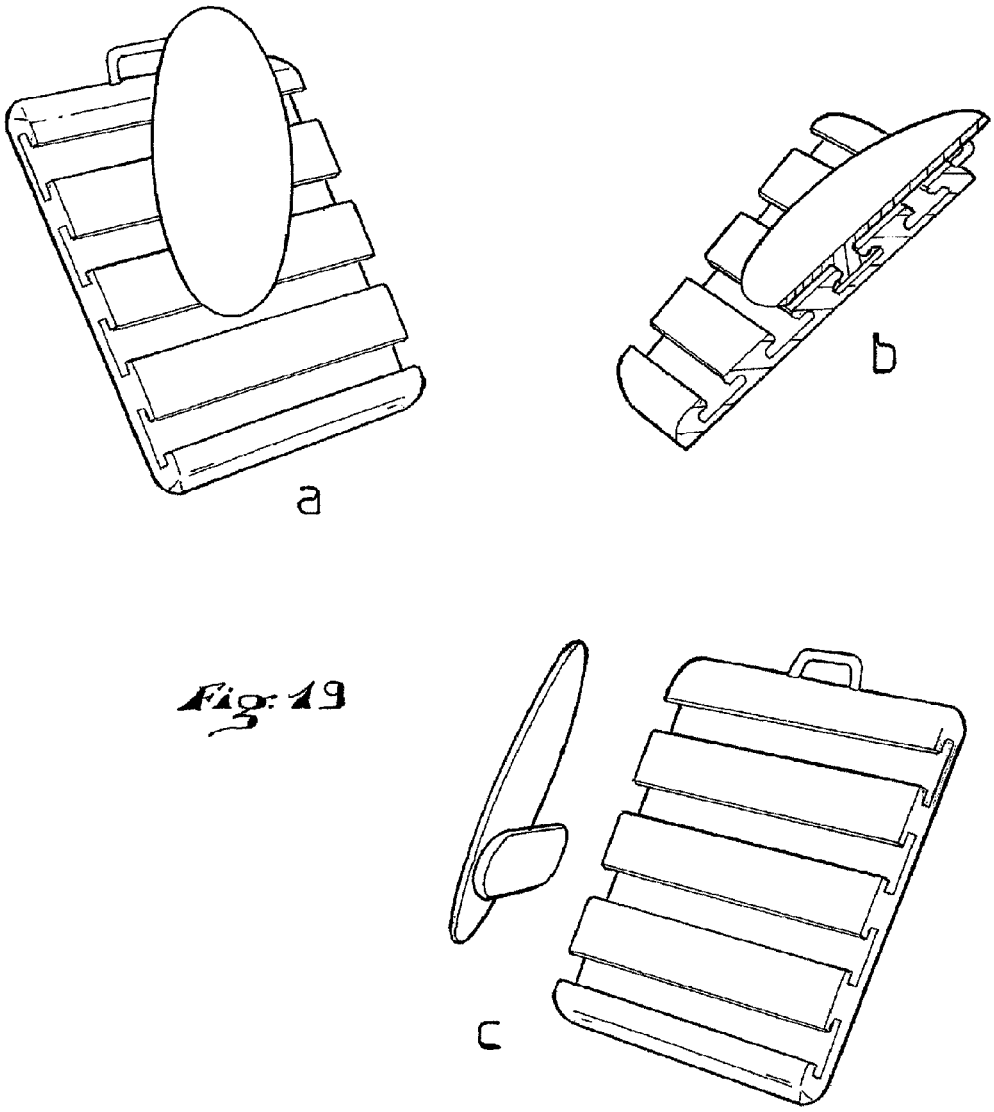

FIGS. **16*a*-16*i* illustrate additional views of a backpack according to the invention, FIG. 16*a* being a view similar to that of FIG. 8**, showing a pivotal hip-belt arrangement in combination with an adjustable shoulder strap mechanism mounted on the back side of the backpack;

FIGS. **17*a*-17*c*** illustrate a first alternative embodiment of an adjustable shoulder strap mechanism;

FIGS. **18*a*-18*d* illustrate a second alternative embodiment of an adjustable shoulder strap mechanism; and FIGS. 19*a*-19*c*** illustrate a third alternative embodiment of an adjustable shoulder strap mechanism.

DETAILED DESCRIPTION OF THE INVENTION

Figure 1:
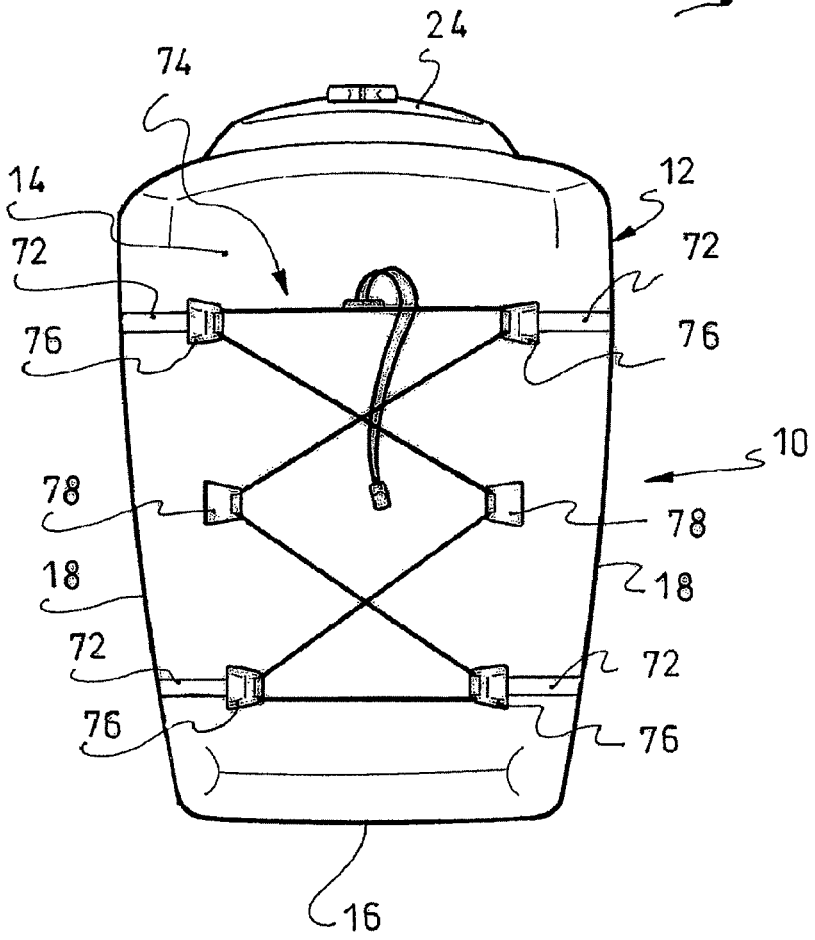
FIG. 1 is a front view of a backpack according to the invention, the opening of the pack being closed.
Figure 2:
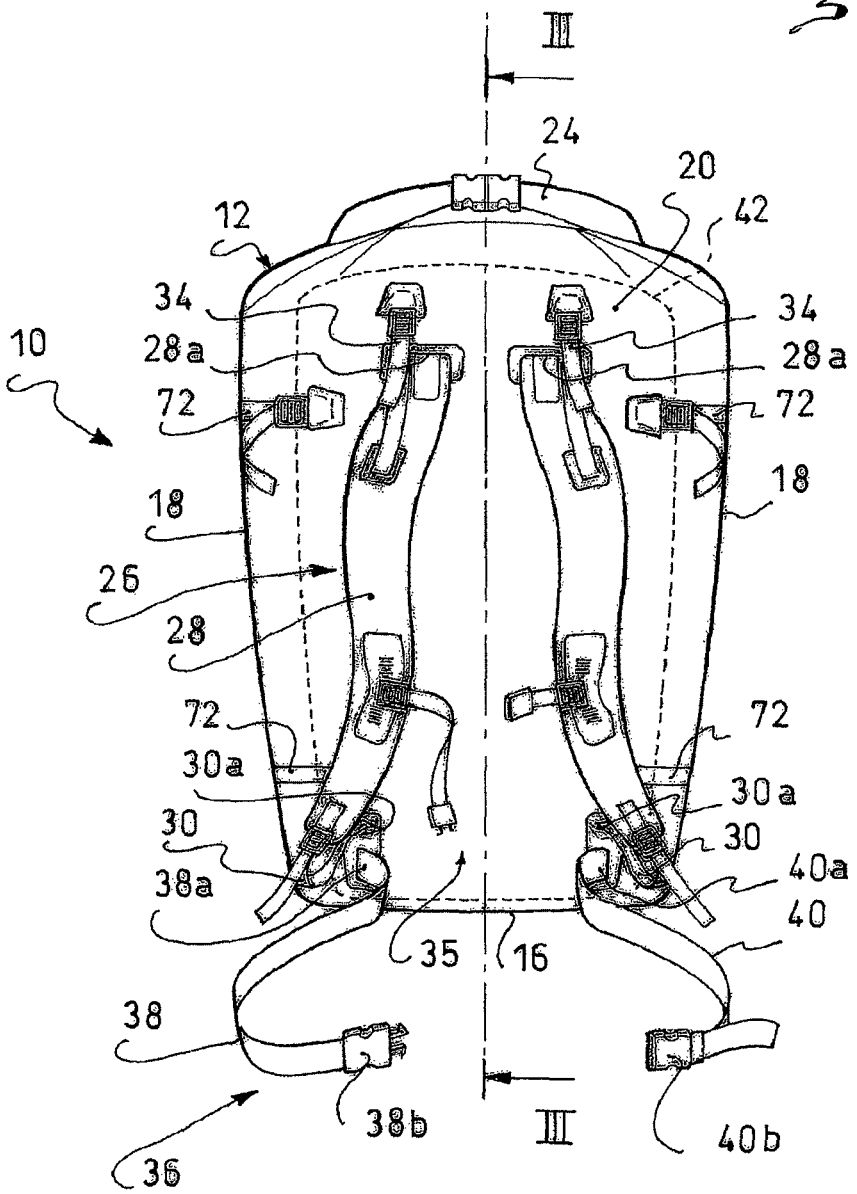
FIG. 2 is a back view of the backpack, the adjustment mechanism of the invention not being shown.
Figure 3:
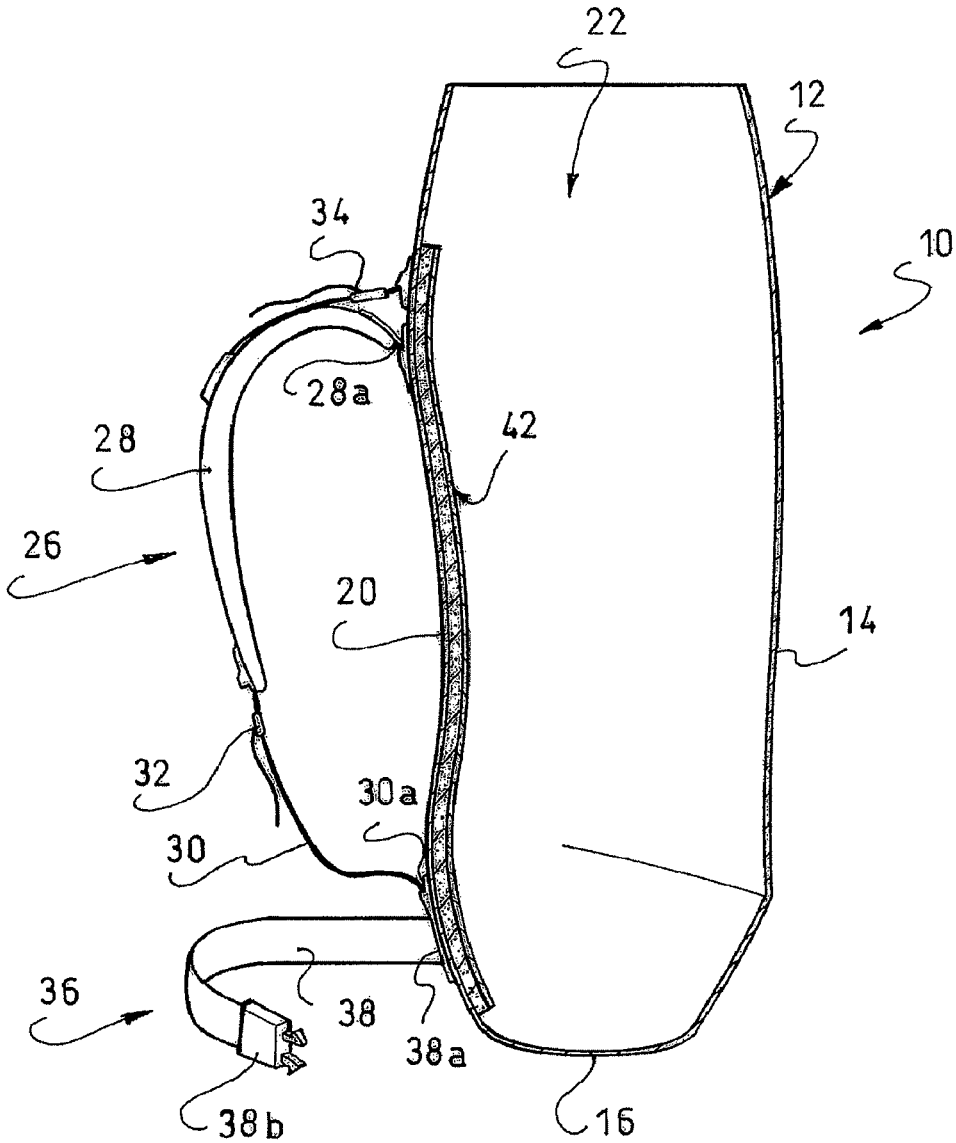
FIG. 3 is a vertical cut-out view of the backpack along line III-III of FIG. 2, the top opening of the pack being open.

FIGS. 1 to 3 show a backpack 10 of the type with which the invention can be implemented, although the adjustment mechanism is not shown in these figures. Before a description of the adjustment mechanism is presented, the illustrated backpack, with which the adjustment mechanism can be implemented, will be described. In fact, FIGS. 1-11 illustrate a backpack disclosed in US 2006/0283907, published on Dec. 21, 2006, the disclosure of which is hereby incorporated by reference thereto in its entirety, and in EP 1 736 074, published on Dec. 27, 2006, both documents being commonly owned herewith.

The backpack 10 has a pack portion 12, which can be substantially entirely made of a flexible material, such as a woven textile fabric. In a particular embodiment, this fabric is coated and/or laminated with at least one water-repellent, water-resistant, and/or water-proof material.

The pack portion basically exhibits a front side 14, a bottom side 16, two lateral sides 18, and a back side 20 which, when the backpack 10 is worn by a user, faces the back of the user.

The pack portion 12 demarcates at least one inner compartment 22 of the backpack which can accommodate a load to be carried. The inner compartment can have internal subdivisions, and the pack portion could also have outside pockets. The over-all shape of the pack portion 12 is designed both to provide a practical shape of the inner compartment 22, adapted to receive the objects which will constitute the load to be carried, and also to provide a bag which, when loaded, is comfortable for the user to carry. Although such shape will usually be substantially parallelepipedic, the exact shape can be far more complex. Such shape of the pack portion can be achieved through the tailoring of various panels of material having each a specific contour and assembled along well-defined junction lines. Such assembly can be performed by any known technique and especially by sewing. In cases in which the pack portion material is water-resistant or water-proof, the assembly technique can be matched, for example, with the use of taped seams which offer very good resistance to the ingression of water.

In the embodiment shown in the figures, the pack portion 12 has a top opening, which means that the main access to the internal compartment 22 is through its top opening. Indeed, as shown in FIG. 3, the upper part of the pack portion 12 is basically tubular and open towards the top. The closure system can be a roll-top type closure (as shown by reference numeral 24 in FIGS. 1 and 2), or a simple hem-and-draw-cord type closure, possibly covered by an upper lid (not shown). Any known closure arrangement can be adapted to a backpack according to the invention. Further, the invention is not limited to an open top backpack and can be implemented with other forms of backpacks, for example with a backpack having only a zippered opening in one of its sides, such as the front side, for example.

The backpack shown in FIGS. 1-3 has a carrying system on its back side 20.

In this embodiment, the carrying system first comprises a pair of carrying members in the form of shoulder straps 26, both of which are attached to the pack portion at both ends. Each shoulder strap 26 is made of two strap parts: an upper strap portion 28 which is attached by its upper end 28*a* to a corresponding attachment location on the back side 20 of the pack portion 12, and a lower strap portion 30 whose lower end 30*a* is attached to a corresponding attachment location of the pack portion 12. As described with reference to FIGS. 12-19, below, an adjustment mechanism can be provided to attach the upper strap portion of a backpack, such as upper strap portion 28, at any of a plurality of attachment locations on the back side of the pack portion. The lower strap portion 30 can be attached to the back side 20 of the pack portion (as in the example shown), but it can also be attached to other sides of the pack portion, for example either of the lateral sides 18, the bottom side 16, or even the front side 14. The two strap portions 28, 30 are connected one to another through a buckle 32 which permits adjustment of the effective length of the shoulder strap 26. In the example shown, each shoulder strap 26 is equipped with an adjustable load stabilizing strap 34 whose lower end is attached on the shoulder strap 26 and whose upper end is attached to the back side 20 of the pack at a location above the upper strap attachment portion. By varying the length of such stabilizing strap 34, the user can move the load closer to or further from his/her back.

Figure 7:
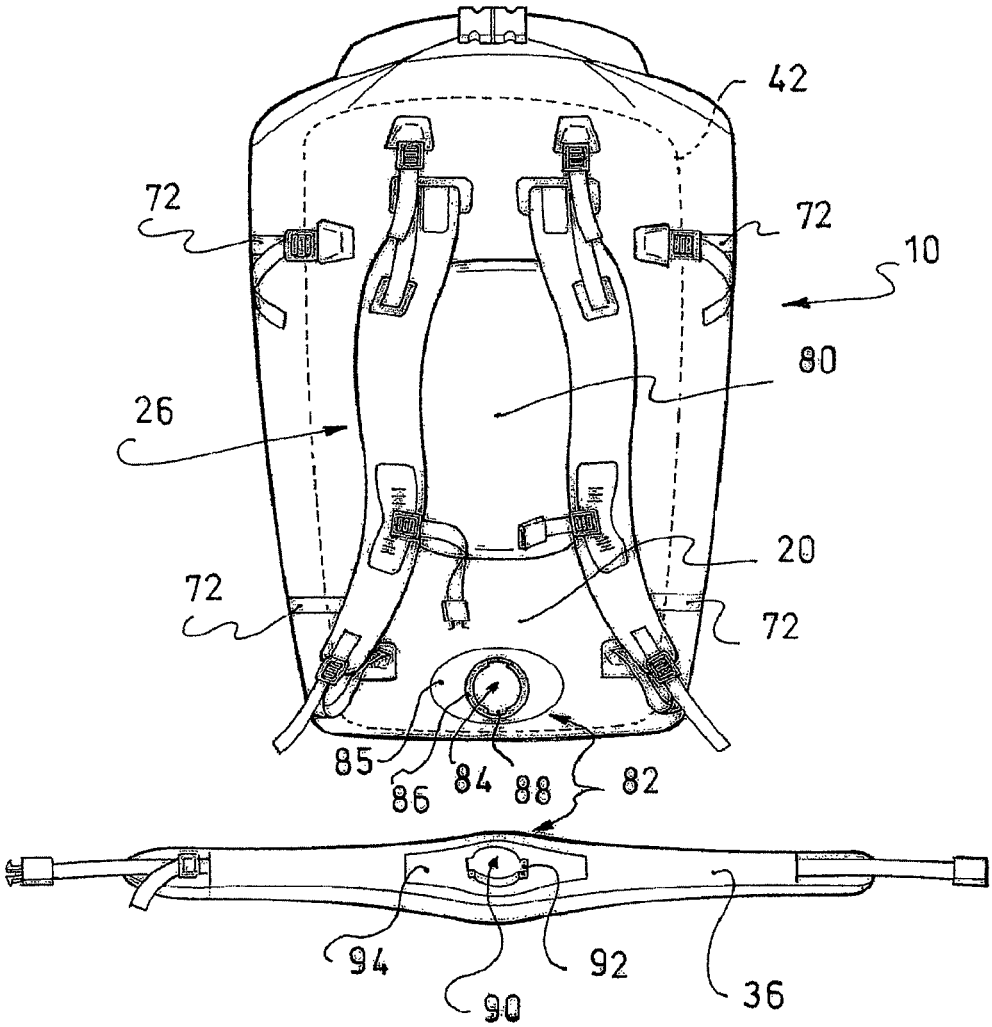
FIGS. 7 and 8 are rear views of a second embodiment of the invention having an improved hip-belt arrangement, respectively before and after the mounting of the hip-belt on the pack.

Particularly for bags over 20-30 liters in capacity, the carrying system may also comprise a hip-belt 36 located in a lumbar portion 35 of the back side of the pack. As shown in FIGS. 1-3, a hip-belt 36 can be very simply made of left and right strap parts 38, 40, each having a fixed end 38*a*, 40*a* attached to the back side 20 or to a corresponding lateral side 18 of the pack portion 12 at respective attachment locations. The strap parts 38, 40 have then on their free ends a pair of corresponding fastening buckles 38*b*, 40*b*, which enable the hip-belt 36 to be closed and tightened around the hips of the user. With a simple hip-belt 36, the lower portion of the back side of the pack (for example its lumbar portion 35) can come directly into contact with the back of the user. Such a simple hip-belt 36, with strap parts 38, 40, generally assists in laterally stabilizing the bottom part of the backpack 10. A hip-belt 36 can also be made of a more comfortable cushioned structure, as shown in FIGS. 7 and 8, which is to be attached to the lumbar portion of the back side of the pack and which can be closed and tightened around the hips of the user. With such a hip-belt 36, one can achieve, in addition to the aforementioned stabilizing effect, a substantial load transfer from the shoulders of the user to the user's hips, making the carrying of large loads far more comfortable. As an alternative to the specific assembly described above, the invention encompasses the use of any of several different types of hip-belts, or hip-suspension assemblies that are known to those skilled in the art.

A carrying system described above is generally more efficient and comfortable for carrying large loads. For bags intended to carry lighter loads, a backpack made according to the invention can have a simpler carrying system. Such system can have only the two shoulder straps, or it can even have one single shoulder strap, ideally then positioned diagonally across the back side of the backpack. The invention can also be carried out on a lumbar pack, which is a kind of small backpack having only a hip-strap or hip-belt as a carrying system, and which a user carries on the lumbar part of his/her back.

The backpack according to the invention can include a frame 42 which is connected to the pack portion 12. According to the invention, this frame 42 comprises at least a rigid or semi-rigid sheet which is affixed to the back side 20 of the pack portion 12 by adhesive bonding, that is, by gluing or welding, as mentioned above.

The frame 42 is a sheet frame in the sense that it has one dimension (its thickness) which is significantly smaller than to its two other dimensions (height and width), making it possible to define a main general plane of the frame (although the frame will, in a particular embodiment encompassed by the invention, not be perfectly planar, but will be slightly curved to follow at least partially the natural shape of the back of the user to enhance ergonomics).

The frame is also rigid or semi-rigid, at least in comparison with the flexibility of the fabric from which the back side of the pack portion is made. That is, in this regard, in the context of this disclosure, a "rigid or semi rigid frame" can be regarded as a "rigidifying" frame in that the frame is at least more rigid than the back side 20 of the pack portion 12 to which the frame is secured. In addition, or alternatively, the rigid or semi-rigid characteristic of the frame can also be regarded by its capacity to withstand substantial compressive forces directed along its main general plane without any significant deformation, compared, for example, to a flexible fabric. On the other hand, despite its rigid or semi-rigid characteristic, the frame can be bendable. Such rigidity of the sheet frame can come from the rigidity of one specific component (e.g., a plastic sheet). But it can also come from the layering of several components which are individually flexible but, when considered after assembly, show the required rigidity.

In the embodiment shown in the drawing, the frame 42 is substantially rectangular in shape and extends along almost the entire surface of the back side 20 of the backpack 10. Such provision allows for the maximum performance of the frame, but one could also provide for a frame having smaller dimensions and/or different shapes. Indeed, the frame 42 could cover only the upper part of the back side 20, or it could have a top part wider than a bottom part. It could also be substantially V-shaped or Y-shaped. It could also have one or several apertures in regions where no rigidification is needed. It could have the shape of an inverted A. As shown in FIG. 2, for example, the frame 42 (in broken lines) is shown to have a width less than the width of the back side 20, or back wall, of the pack portion 12, along a portion of the height of the wall. That is, the wall extends widthwise beyond the subassembly formed by the wall and the frame.

According to one aspect of the invention, the frame 42 is connected to the back side 20 of the pack. Depending on the nature of the frame and on the nature of the flexible material of the back side, different adhesive bonding techniques can be used. If the materials are compatible, the frame can be affixed to the back side by welding, such as, for example ultrasonic or radio-frequency welding.

In most cases, the adhesive bonding can be achieved through the use of an adhesive material such as glues or glue-containing compounds. Many types of glues can be used, such as, for example, polyurethane-based glues. Such glues can be in the form of self-standing films or in liquid form. They can be thermo-activated glues, e.g., hot-melt glues.

Figure 4:
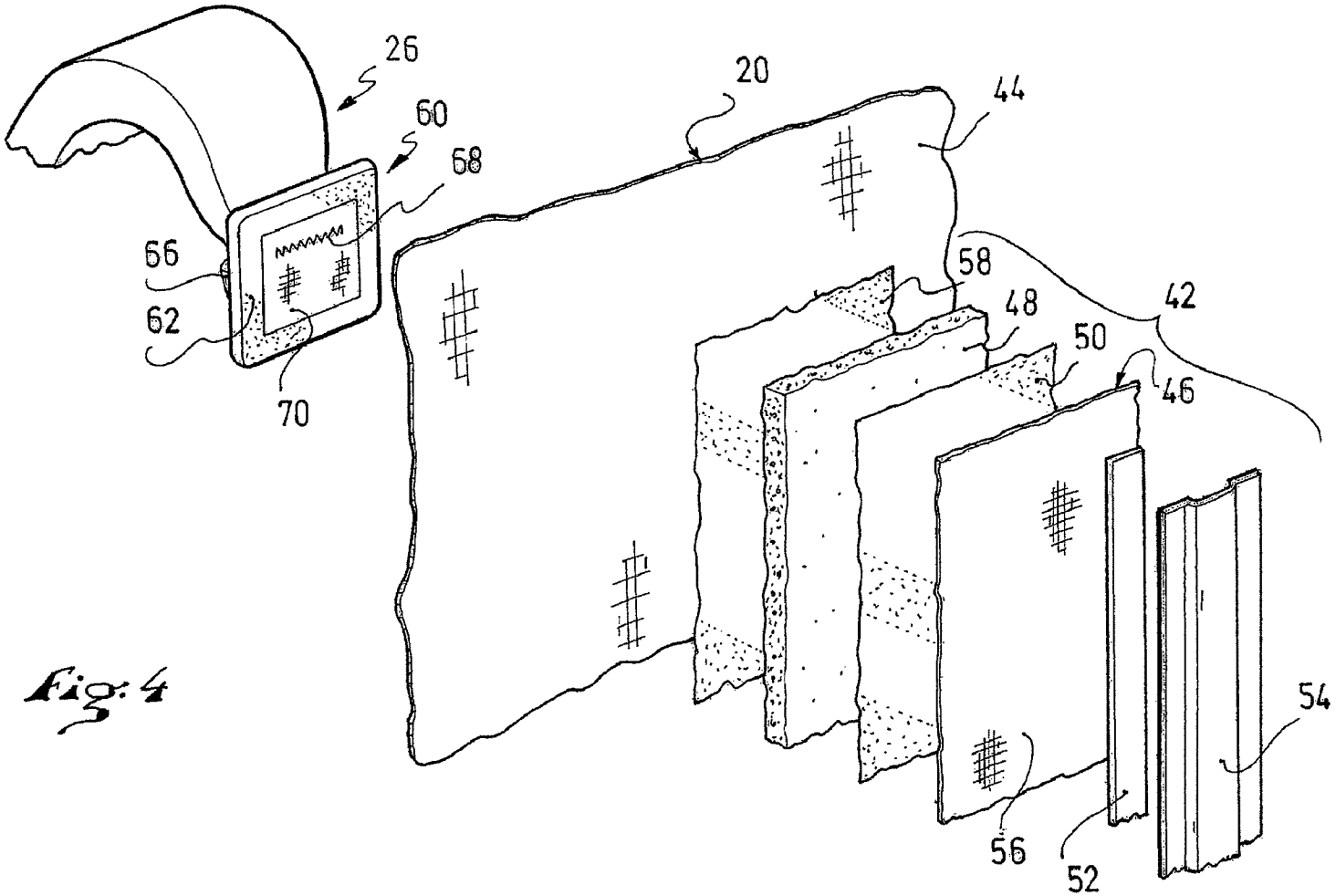
FIG. 4 is an exploded vertical cut-out view showing one embodiment of an adhesively bonded sheet frame according to the invention.

An exemplary embodiment of this innovative frame 42 is shown in greater detail in FIG. 4. In this embodiment, the frame 42 is adhered to the inner surface 44 of the back side 20 of the pack portion 12 of the backpack, thereby creating a layered subassembly. As mentioned above, the pack portion 12 is, for example, made of a Nylon-based woven textile which can be laminated on its inner surface with a water-impermeable film, for example a polyurethane film. It can also be coated on its outer surface with a water-repellent or water-resistant coating, for example a polyurethane coating.

The frame 42 has a first main component comprising a structural sheet 46. It can be made of any semi-rigid or rigid material, such as plastics, composite materials, metal, etc. It preferably has the appropriate thickness to exhibit enough strength without excessive weight. The structural sheet 46 can be conformed to the shape on the back of a user, either by thermoforming or by appropriately shaping a reinforcing stay, if used to reinforce the frame 42 (such as stay(s) 52, mentioned below). Its shape may be modified (e.g., by thermoforming or by reshaping the stay(s)) to be better adapted to a specific user.

The frame 42 also has a sheet of foam 48 which is to be sandwiched between the structural sheet 46 and the back side 20 of the pack portion 12 of the backpack. The foam sheet 48 can be made advantageously of an elastic foam, which provides extra carrying comfort to the bag and abrasion-resistance around the perimeter of the structural sheet 46. Nevertheless, rigid or semi-rigid foams may also be used. The structural sheet 46 and the foam sheet 48 are joined one to another, along their entire contacting surface or at least along a substantial portion thereof, by adhesive bonding. As shown in FIG. 4, a thermo-activated adhesive can be used, such as a film of hot-melt adhesive, or a gluing compound 50 to glue the foam sheet 48 to the structural sheet 46. The gluing compound 50 may be made of two or more films of hot-melt adhesive, for example, possibly of different compositions to adapt to the specific materials of the structural sheet 46 on one side and of the foam sheet 48 on the other side. The gluing compound can also have an interfacial layer between two adhesive films. The interfacial layer can be a fabric layer, for example. If a thermo-activated film is used, it is necessary to a select film which has an activating temperature (melting temperature for a hot-melt film) less than the temperature at which the flexible material of the back side 20 may start being damaged.

In the example shown, the frame 42 is reinforced by one or several rigid stays 52 (or rods, only one depicted in FIG. 4). In the example shown, the stay 52 is arranged substantially vertically and it is housed in a gusset 54, or pocket, which is attached on the internal surface 56 of the structural sheet 46, for example attached by adhesive bonding along its two vertical borders. The gusset 54 can be open at its top end, and the stay 52 is mounted in the gusset so as to be removable by sliding it out of the gusset. A short flap could be affixed at one end to the structural sheet and extend over the end of the gusset to retain the stay in place, the other end of the flap having a closure, such as a snap or a Velcro® fastener, e.g., to permit access to the stay. The stay 52 can be made of aluminium or other metal, rigid plastics, fiber-reinforced composites, including sandwich type composites, etc. Instead of being inserted in a gusset, the stay could be directly glued onto the structural sheet 46.

According to the illustrated embodiment of the invention, the frame 42 (here comprising the structural sheet 46, the foam sheet 48, and one or several stays 52) is attached to inner surface 44 of the back side by adhesive bonding. In the example shown, the adhesion is obtained using a holt-melt film adhesive 58, or using a gluing compound as described above. Alternatively, other types of adhesives can be used.

The frame 42 could also be constructed as a sandwich structure having a spacing layer (for example made of foam) between two structural sheets (of the same material or of different materials).

The frame 42 can be adhered to the back side 20 along an adhesion zone covering the entire contacting surfaces of the frame and back side, or at least a substantial portion of the contacting surfaces. In the latter case, the adhesion zone is preferably continuous, although that is not limiting according to the invention. It can be made of a regular pattern of patches, for example, without any adhesive bonding (for example to save some weight of the gluing compound). Most importantly, the adhesion zone preferably covers parts of the back side where elements of the carrying system are anchored. In other words, the adhesion zone at least corresponds to the various attachment portions of the carrying system. At least at its locations corresponding to such attaching portions, the frame is substantially flat so as to achieve a continuous and integral contact leaving no void between the frame and the material of the pack portion along those locations. Indeed, such continuous and integral contact considerably reinforces the mechanical strength of the pack portion 12 under the attachment portions.

Indeed, as shown in FIGS. 2 and 3, the attachment portions connecting the ends 28*a*, 30*a* of the shoulder straps 26 and the attachment portions connecting the ends 38*a*, 40*a* of the hip-belt straps 38, 40 on the back side 20 are located on portions of the back side which are located within the area covered by the frame 42. Similarly, the attachment portions for the ends 34*a* of the stabilizing straps 34 on the back side 20 are also within the periphery of the frame 42. Therefore, it is advantageous to ensure that the adhesion zone of the frame 42 covers the corresponding attachment portions. By such provision, the frame 42 makes a direct mechanical linkage between each element of the carrying system. The carrying forces transferred between the carrying elements being directed parallel to the general plane of the frame, the frame can be considered substantially rigid with respect to such forces. Moreover, due to the fact that the frame 42 is adhesively bonded to the back side 20 of the pack portion 12 of the backpack 10, therefore inhibiting any undesirable movement between the back side 20 and the frame 42, such linkage is geometrically perfectly stable and well-defined. It is not be affected by any unwanted displacement of the various elements and, therefore, guarantees a very precise transfer of loads between the backpack and its user. Such precision is crucial in avoiding unwanted movements of the backpack altogether relative to the user. Such unwanted movements could create a certain amount of unbalance to the user, and it is therefore a great advantage of the backpack according to the invention that such movements be minimized.

Therefore, from a load stability standpoint, it is advantageous to have a unitary sheet frame 42 underlying all attachment portions of the carrying system, such as attachment portions for the strap ends 28*a*, 30*a*, 34*a*, 38*a*, and 40*a*.

But, in some cases, it may be sufficiently satisfactory that the adhesively bonded frame 42 underlie only part of the back side 20, and not all the attachment portions.

One possibility, therefore, is to have the adhesively bonded frame 42 underlie and extend between the attachment portions of the upper and lower ends of the shoulder straps, and/or underlie and extend between the attachment portions of the upper ends of the shoulder straps and of a hip-belt arrangement, the adhesion zone of the frame 42 to the pack portion 12 corresponding at least to the attachment portions.

In another exemplary embodiment, the sheet frame 42 can be made of several parts each independently adhesively bonded to the pack portion 12. For example, two separate sheet frames can be provided, one for the left part of the pack portion and one for the right part of the pack portion of the backpack.

In other exemplary embodiments, the sheet frame can be divided into two or more separate parts along substantially horizontal partition lines. In such cases, the sheet frame parts are located adjacent one to another so that their lateral borders along the partition lines are in abutment one with the other. In such a case, such multi-part sheet frame can be united by a rigid structure, such as one or several common stays slidably inserted in corresponding gussets arranged on the frame parts. With such a construction, the sheet frame is foldable when the stays are removed, and recovers some rigidity altogether when the stays are in place.

Another innovative aspect of the backpack according to the invention is that at least some of the elements of the carrying system are attached to the pack portion 12 by adhesive bonding, and more specifically by gluing, i.e., by the provision of a specific adhesive material or compound.

FIGS. 4, 5, and 6 show more precisely how the upper end 28*a* of a shoulder strap 26 can be attached to the pack portion 12 by gluing.

In the embodiment shown, the upper end 28*b* of the shoulder strap 26 is made of a textile web or strap and it is fixed on an attachment portion, in the form of an anchoring base 60. The anchoring base 60 is made of flexible plastic material (for example polyurethane) having a rear surface 62 facing the pack portion 12, and a front surface 64 on which the upper end 28*a* of the shoulder strap 26 is fixed by stitching 68. More precisely, the anchoring base 60 has a housing 66 formed on its front surface 64 adapted to receive and hide the extremity of the upper end 28*a* of the shoulder strap 26. The housing 64 is closed in all but one direction, i.e., only open along a direction parallel to the base for introduction of the extremity 28*a* of the strap 26 in the housing. The stitching line 68 for holding the upper end 28*a* of the strap 26 on the base 60 is made just in front of the housing's opening. To increase the strength of the stitching 68 (specifically to avoid any risk of tearing of the base material), the back surface 62 of the base is backed with a piece of woven fabric 70, and the stitching is done through the upper end 28*a* of the strap, through the base 60, and through the woven fabric reinforcement 70. According to a particular exemplary technique, the fabric reinforcement 70 is located in a recess which is provided in the back surface 62 of the anchoring base 60, so that the fabric reinforcement 70 is flush with the back surface 62.

According to a particular aspect of the invention, the anchoring base 60 is then affixed to the outer surface of the back side 20 of the pack portion 12 by gluing.

In order to prevent any risk of the shoulder strap 26 peeling off, the anchoring base 60 is glued at a location of the back side 20 where the reinforcing frame 42 is also adhered to the back side 20 (on its inner side). Therefore, the frame underlies and is directly bonded to the attachment portion for the shoulder strap. That is, the anchoring base 60, the back 20 of the pack portion 12, and the reinforcing frame 42, with adhesive bonds between adjacent ones of these parts create a laminate structure in the area of the base of the strap 26. This prevents any severe bending of the substrate (i.e., the back side fabric 20) on which the anchoring base 60 is glued, which severe bending would promote peeling off near the edges of the base 60. Another advantageous provision is to ensure the edges of the base 60 are sufficiently thin and flexible to follow easily any residual bending of the substrate without exerting too much peeling off stress on the glue. Yet another advantageous provision is to use an adequate substrate. Indeed, particularly when it comes to affixing a shoulder strap by adhesive bonding, it is necessary to use a substrate which is specifically designed therefor. For example, if the substrate is a fabric coated or laminated on its outer side (for example, a woven textile coated with a water-repellent or water resistant polyurethane coating), the coating (or laminate) should have an adhesion resistance to the base fabric, or peeling resistance, of at least 10 pounds per inch (10 lbs/in; approximately 68947 N/m2) according to Federal Test Method Standard 191A/5970 (or according to corresponding ASTM Standard D-751), although preferably about 18-20 lbs/in or greater is contemplated according to the invention. In practice, a peeling resistance of about 30 lbs/in, and slightly higher, can be achieved using a polyurethane coating.

In the embodiment shown, each element of the carrying system is affixed to the pack portion through the gluing of an anchoring base 60 described above: the upper and lower ends 28*a*, 30*a* of the shoulder straps 26, as well as the ends 38*a*, 40*a* of the hip-belt straps parts 38, 40, and the ends 34*a* of the stabilizing straps 34. Some of the elements can share the same anchoring base, as for example the lower end 30*a* of the shoulder straps and the corresponding ends 38*a*, 40*a* of the hip-belt strap parts 38, 40. Moreover, the anchoring base of each element is glued at a location of the back side 20 where the reinforcing frame 42 is also adhered to the back side (on the inner side).

As shown in FIGS. 1 and 2, the same affixing technology can be used for other accessories on the backpack, as for example for the compression straps 72 and the front chock-chord system 74. Those accessories, not being exposed to significant loads, can be affixed by gluing on parts of the pack portion which are not reinforced by the frame. They can also use much smaller anchoring bases 76, 78, and can also share such anchoring bases 76.

FIGS. 7 and 8 illustrate a second embodiment of a backpack according to the invention. This second embodiment only differs from the first embodiment by the presence of a comfort pad 80 which is glued on the outer surface of the back side 20 of the pack, and by the presence of a hip-belt 36 which is connected to the back side 20 of the pack portion by a disconnectable pivoting connection mechanism 82 which is very schematically depicted.

The pivoting connection mechanism 82 has a socket 84 which is affixed to the back side 20 of the pack portion, in a lumbar part thereof. The socket 84, another exemplary embodiment of which is shown on FIGS. 9 and 11, can be affixed by any known technique, but it will be most advantageously affixed by adhesive bonding, e.g. by gluing. The socket has a base 85, the size of which can be adjusted to provide enough adhesion surface, and an annular rim 86 with a number of internal radial grooves 87 (only two in FIG. 7, but four in FIGS. 9 and 11). Each radial groove 87 extends around a certain angle. The rim 86 has a corresponding number of notches 88, each at one extremity of the corresponding groove 87.

Figure 9:
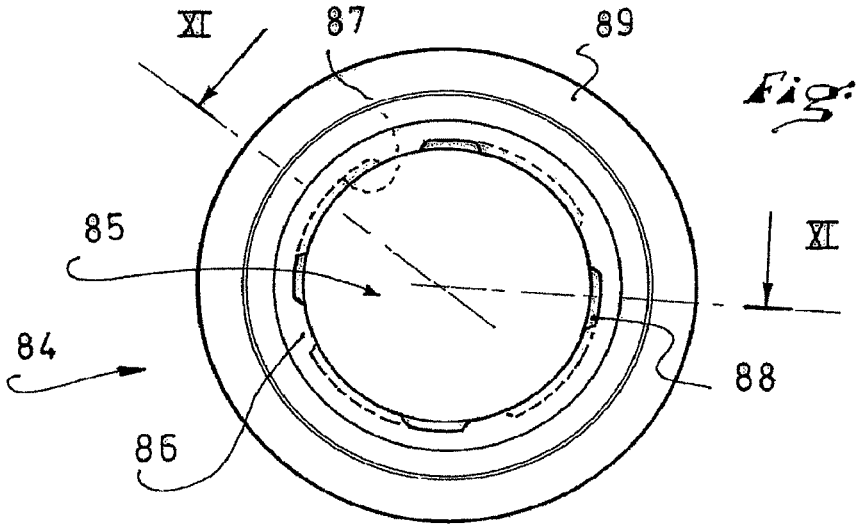
FIGS. 9 and 10 show the two parts of a hip-belt pivoting connection mechanism.
Figure 10:
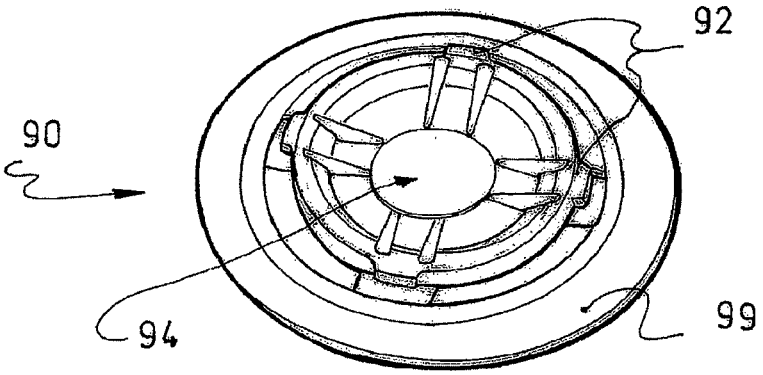
Figure 11:
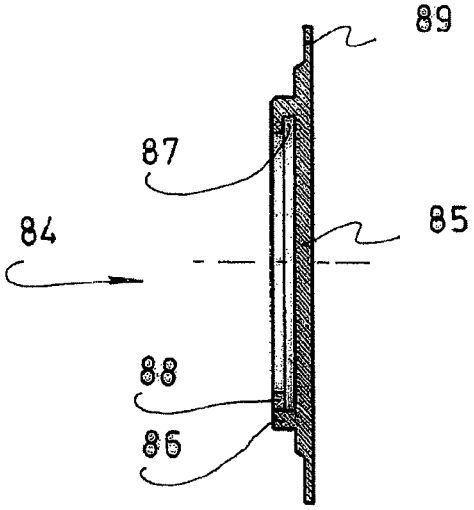
FIG. 11 is a cut-out along line XI-XI of FIG. 9.

As shown in FIG. 7, the pivoting connection mechanism 82 has, affixed to the hip-belt 36, a cylindrical fitting 90 (adapted to be axially fitted within the annular rim 86 so as to form a pivoting connection) with radial studs 92. Another exemplary embodiment of a fitting 90 is shown in FIGS. 9 and 11. The studs 92 correspond in shape and in number to the notches 88 of the rim 86, so that they can be introduced axially through the notches 88, and, by a proper rotation, so that they can be inserted in the radial grooves 87 of the socket 84 to prevent the axial release of the fitting 90 from the socket 84, while allowing a rotation of the fitting relative to the socket. The pivoting connection, thusly constructed, allows for rotation upon to 180° in each direction, i.e., clockwise and counter-clockwise, without risking release of the fitting from the socket, although a total range of 120° rotation around a horizontal plane can provide a suitable versatility to the user.

The fitting 90 also has a base 94 by which it can be affixed to the cushioned hip-belt 36, for example by gluing. As shown more specifically in FIGS. 9 to 11, the base parts 85, 94 of the socket 84 and of the fitting 90 preferably has an outer peripheral flange 89, 99 which is flexible. The flexible flange 89, 99 of both parts, in this exemplary embodiment, are integral with the base, each connection part being preferably molded in one piece from plastic material. In such a case, the outer flanges are made sufficiently thin to be flexible, while the rest of the part is substantially rigid. In the illustrated embodiment, the flange is merely an extension of the base part so that they exhibit a single flush back surface, adapted to lie against the corresponding element of the pack. The flexible flange portion 89, 99 of the parts are very important if those parts are assembled by adhesive bonding because they would prevent or at least reduce the risk of peeling off.

Many types of known alternative pivoting connections could be used, and one skilled in the art can readily construct a convenient embodiment. More complex connecting mechanisms could also be used to link the hip belt to the pack, for example mechanisms with dual pivoting rods. In addition, the socket and the fitting could have interchanged positions on the hip-belt and on the pack.

The above cushioned hip-belt 36 and its pivoting connection mechanism 82 are particularly relevant in the context of the invention where the back side 20 of the pack, and particularly its lumbar part, is reinforced by an adhesively bonded frame 42. Indeed, the presence of the frame 42 in the lumbar part of the pack, where the hip-belt 36 is also connected the pack, permits a very stable and precise fixing of the pivot mechanism 82. If the latter is also adhesively bonded to the pack, there would be no disadvantageous lateral or vertical movement between the hip-belt, the frame 42, and the shoulder straps 26, achieving superior carrying ability. The hip-belt 36 can also be perfectly positioned and tightened around the hips of the user, while the pivot mechanism 82 can provide the adequate freedom of movement between the shoulder straps 26 and the hip-belt 36 for the pack to follow the movements of the user's back.

Supplementing the exemplary embodiments of backpacks shown in the foregoing figures of the drawing, in which emphasis has been placed on the use of adhesive bonding, i.e., gluing or welding, of strap ends and/or other components to the backpack, is an adjustment mechanism that can be incorporated into the structure of the backpack to provide for a selective attachment of a component or an end of a strap, such as an end of a shoulder strap, or the ends of a pair of shoulder straps, in any of a plurality of locations on the backpack. Thereby, rather than adhesively bonding the ends of the shoulder straps, e.g., directly to the back side of the backpack, with or without a rigidifying frame, which would thereby not provide a fine-tuned fit for the backpacker, certain component element(s) of an adjustment mechanism are bonded to the backpack, thereby facilitating a fine-tuned fit of the backpack to accommodate the ergonomic requirements of the individual backpacker. Alternatively, rather than adhesively bonding certain component element(s) of the adjustment mechanism, they can be made as part of a one-piece part of the backpack, such as part of an injected molded part thereof, i.e., such as part of an injected molded frame sheet. If the frame sheet is mounted internally of the backpack, an appropriate opening in the back of the backpack can be made for exposing the connector sites of the adjustment mechanism element. As an alternative to being unitarily molded with the frame, such component element(s) can be adhesively bonded to such frame sheet if a frame is used.

An exemplary embodiment of such an adjustment mechanism is shown in FIGS. 12-15. Additional embodiments and details thereof are shown in FIGS. 16-19.

Figure 12:
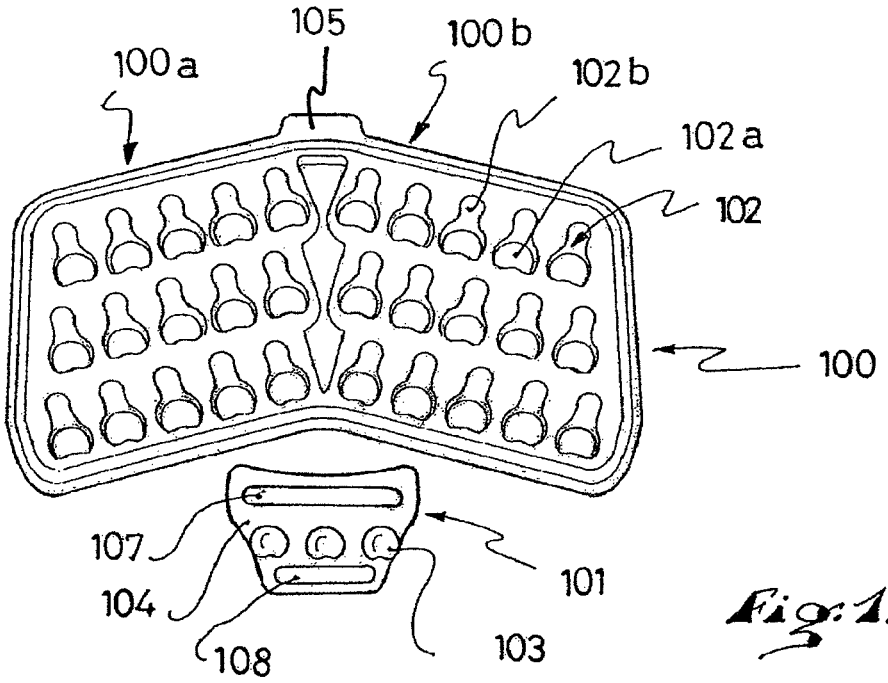
FIG. 12 is an illustration of first and second elements of an adjustment mechanism for attachment of a shoulder strap to the backpack of any embodiment of the invention, including that of FIGS. 1-3 and that of FIGS. 7 and 8, the elements being shown not yet bonded to the backpack.
Figure 13:
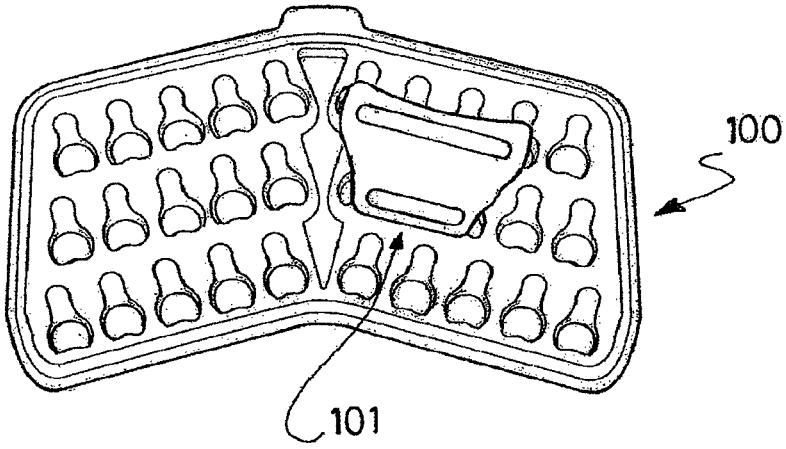
FIG. 13 is another illustration of the first and second elements of the adjustment mechanism of FIG. 12, with the second element being connected in one of a range of a different locations on the first element.
Figure 14:
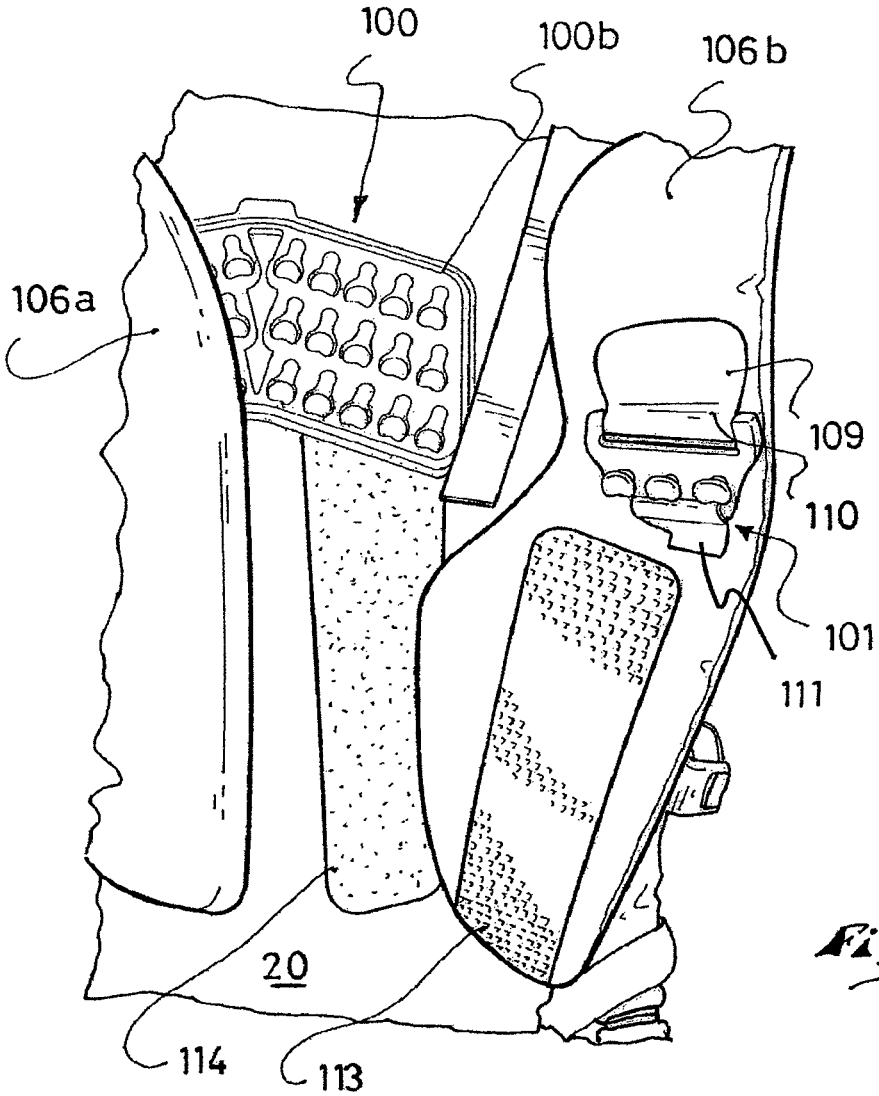
FIG. 14 is an illustration of the first element of the adjustment mechanism bonded to the back portion of the backpack and the second element of the adjustment mechanism bonded to a shoulder strap, the first and second elements of a left-side shoulder strap and the left side of the back side of the backpack being shown disengaged relative to each other.
Figure 15:
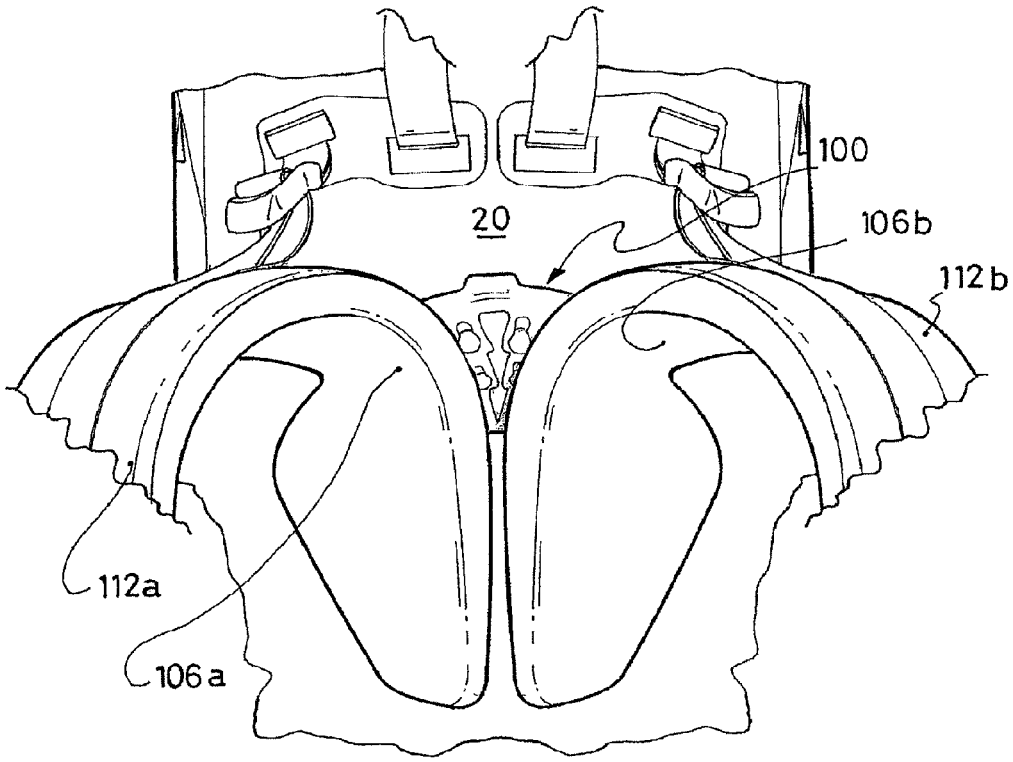
FIG. 15 shows a pair of shoulder straps of the backpack, each strap being secured independently at a location among a plurality of locations within the range of locations provided by the adjustment mechanism.

FIGS. 12 and 13 illustrate, isolated from connection to a backpack, which connection is described below and which is illustrated in FIGS. 14 and 15, two elements or parts 100, 101 of an adjustment mechanism for attachment of a shoulder strap to a backpack. More specifically, shown in FIGS. 12 and 13 are a receptacle part 100 and an insert part 101 that are to be removably coupled together. In a non-limiting example, the receptacle part 100 can be adhesively bonded, such as by gluing, to the back side 20 of the backpack 10 of FIGS. 1-3, and the insert part 101 can be adhesively bonded to upper end portion of the shoulder strap, as shown in FIG. 14, and such as to the upper end portion 28 of the shoulder strap 26 shown in FIGS. 2 and 3. FIG. 12 shows the insert part 101 unconnected to the receptacle part 100, whereas FIG. 13 shows the insert part 101 connected in one of numerous possible positions relative to the receptacle part.

In the particular adjustment mechanism that is illustrated, the receptacle part 100 is comprised of a one-piece plastic frame, manufactured by injection molding or other technique using, as an example, polyurethane or a blend of polyurethane and other plastic. In the illustrated embodiment, the receptacle part 100 is made in one piece, which includes a first half or section 100*a* and a second half or section 100*b*, each of the sections 100*a*, 100*b* serving to be removably engaged with insert parts 101 of respective ones of a pair of shoulder straps, as described below in greater detail.

In an alternative embodiment, each of the receptacle sections 100*a*, 100*b* can be comprised of a one-piece plastic frame, each such frame being independently bonded to the back side of the backpack.

As shown in FIG. 12, each of the halves of the receptacle part 100 includes an array of receptacles 102 comprising, in the illustrated non-limiting embodiment, three rows of five columns, i.e., a grid of receptacles. In the illustrated embodiment, the rows of receptacles are straight rows of distinct spaced-apart receptacles, with each of the receptacles having a closed periphery. In the illustrated embodiment, the peripheral shape is that of a keyhole. The number and arrangement of the individual receptacles 102 can take any of a plurality of forms, although the form that is illustrated provides for a convenient range of options for the backpack user, because it allows for independent adjustment of one shoulder strap relative to the other shoulder strap, both vertically and horizontally, or adjustment along a first direction and along a second direction transverse to, i.e., intersecting with, the first direction or, with regard to the particular illustrated embodiment, longitudinally along the length of the bag/pack and transverse thereto, as can be readily understood from the drawing and from the further description below. Each of the receptacles 102, which can be considered connector sites for receiving the button heads 103 of projections, or connector sites, of the insert part 101 further described below, includes an enlarged portion 102*a*, shown to be circular—or somewhat circular—in the drawing, which is recessed relative to the uppermost surfaces of the receptacle part 100, and a narrowed portion 102*b*, extending upwardly from the circular portion. In a particular embodiment, the bottom extents of the circular portions of the receptacles 102 can be somewhat flattened or, as shown in the drawings, slightly concave.

The insert part 101 of the adjustment mechanism shown in FIG. 12, which is to be removably connected to the receptacle part 100, includes a line of three somewhat circular buttons 103, which buttons are spaced apart by a distance equal to the distance by which the keyhole-shaped receptacles 102 are spaced apart within each of the sections 100*a*, 100*b*. The insert part 101 includes a carrier 104, or base, for the buttons 103. Each of the buttons 103 extends from one side of the base 104 of the insert part 101 by means of a stem and has a peripheral profile complementary to that of the receptacles 102. The insert part, like the receptacle part, can be made as a one-piece molded part. Alternatively, the buttons 103 can be made separate from the remainder of the part and individually secured thereto, such as by screw-threaded connection of the stems within respective holes or by means of an adhesive securing the stems within respective holes. As shown in the drawing of the illustrated embodiment, each of the buttons 103 has a size and shape to be freely received and removed from the enlarged portion 102*a* of the receptacle 102 and to be retained beneath the narrowed portion 102*b* of the receptacle 102. As also shown in the illustrated embodiment, the individual receptacles 102 within the array of receptacles are respectively distinct, that is, the recessed portions of the receptacles are not connected. That means that each button 103, if positioned within an individual receptacle 102 of the receptacle part 100, must be disconnected from the receptacle part 100 before being positioned within another individual receptacle 102.

A connection between the insert part 101 and the receptacle part 100 of the adjustment mechanism is made by means of the following sequence: positioning of the insert part 101 so that the three buttons 103 face the array of keyhole-shaped receptacles 102; insertion of the three buttons 103 of the insert part 101 into the circular portions 102*a* of three adjacent keyhole-shaped receptacles 102 of one of the sections, i.e., section 100*a* or section 100*b* of the receptacle part 100; and sliding of the insert part 101 laterally, i.e., in a direction laterally along the facing surface of the part 100, i.e., or upwardly in the context of the orientation of the receptacle part 100 shown in FIG. 12, so that the stems of the buttons 103 slide within the narrow portions 102*b* of the three keyhole-shaped receptacles 102, with the circular heads of the buttons 103 retained beneath the narrowed portions 102*b* of the keyhole-shaped receptacles 102.

According to a detailed embodiment, each of the edges of the narrowed portions 102*b* of the keyhole-shaped receptacles can include slight protuberances to provide a firm engagement with the stems of the buttons 103 to assist in retaining the buttons in the receptacles 102, particularly when the backpack is not being worn and the forces generated by the weight of the backpack is not naturally tending to force the buttons upwardly toward the closed ends of the narrowed portions 102*b* of the keyhole-shaped receptacles.

In FIG. 13, the insert part 101 is shown to be connected to the receptacle part 100, whereby the three buttons 103 of the insert part 101 have been received within three keyhole-shaped receptacles 102 in the leftmost position of the middle row of receptacles 102 of the section 100*b* of the receptacle part 100. Of course, with the array of three rows and five columns, provision is made, with the illustrated embodiment, to adjust the position of the insert part 101 relative to the section 100*b* of the receptacle part 100 by relocating the insert part as many as two keyhole positions to the right and one keyhole position up or down. Thus, the shoulder strap to which the insert part 101 is affixed (further described below) can be, accordingly, adjusted. Similarly, a second insert part (not shown) can likewise be adjustably connected to the section 100*a* of the receptacle part 100 to thereby adjust the position of a second shoulder strap to which the second insert part is affixed.

Although the illustrated embodiment shows the insert part 101 of the adjustment mechanism to have a series of three buttons 103, this is not limiting for the invention. The insert part 101 could, in alternative embodiments, have one or two buttons, for example, or even an array of four or more buttons, such as in two rows of two. However, if fewer buttons (or other such connectors) were to be used, each such button could be made larger so as to carry expected loads for the backpack to which it is a part. Another consequence of making the buttons larger is that each incremental adjustment achieved by moving the buttons one position up, down, left, or right would be increased, because the keyhole-shaped receptacles 102 of the receptacle part 100 of the adjustment mechanism would need to be made larger. On the other hand, a greater number of buttons (and/or a greater number of receptacles) can increase the number of positions by which the insert part 101 can be removably affixed to the receptacle part 100.

Also, if the insert part 101 were to have but a single button 103, the insert part 101 would be allowed to pivot about the axis of the stem of the button, as the stem would be free to rotate within the narrowed portion 102*b* of a keyhole-shaped receptacle 102 of the receptacle part 100. The provision of two or more buttons prevents such rotation.

The techniques described with reference to FIGS. 4-6, above, can be advantageously utilized in affixing the receptacle part 100 of the shoulder strap adjustment mechanism to the back side 20 of a backpack. Although affixing the receptacle part 100 by stitching or other techniques could be implemented, it is the technique of adhesive bonding, whether by gluing or welding, disclosed above, that ensures an increased rigidity for the adjustment mechanism. According to a particular embodiment of the invention, the entirety of the available back surface of the receptacle part 100 can be adhesively bonded, such as with glue, to a laterally central portion of the back side 20 of the backpack, at a location thereof where the reinforcing frame 42 is also adhered to the back side (preferably on the inner side thereof). That is, in the illustrated embodiment, the part 100 adhered to the pack (or part 101 in an alternate embodiment as mentioned herein), together with the back 20 of the pack portion 12, the reinforcing frame 42 (see FIG. 4, for example), and the adhesive bonds between adjacent ones of these parts, create a laminate structure in the area of the connection of the shoulder strap to the pack, i.e., in the area of the part of the adjustment mechanism that is affixed to the pack. This provides for a rigid mounting of the receptacle part 100 on the backpack and enables the receptacle part 100 to carry loads, via the insert parts 101 of each shoulder strap, that are imposed upon it, particularly when the backpack is fully loaded. Also within the scope of the invention, the receptacle part 100 (or other part of the adjustment mechanism) can be adhesively bonded to a backpack that does not utilize a frame, such as frame 42. Alternatively, if such a frame is used, it is also within the scope of the invention to provide a frame, as by injection molding, in which a part of the adjustment mechanism, such as receptacle part 100, is made together, in one-piece, e.g., with the molded frame, whether the frame 42 is made internal or external.

Of course, the back surface of the receptacle part 100 includes through openings in the keyhole-shaped receptacles 102, although available as gluing surface portions are the periphery of the part 100 and much of the strips of material between rows and columns of the receptacles 102, including the circular bases of the circular portions 102*a* thereof. In addition, in the particular embodiment that is illustrated in FIGS. 12-15, there is a central partition, or strip, between sections 100*a*, 100*b*, extending upwardly to a tab 105 that is available to be bonded to the back side of the backpack. If, on the other hand, the receptacle part 100 were to be stitched to the back side of the backpack in a less preferred embodiment according to the invention, the areas of the part that would be secured would not provide as great a rigidity for assuming the forces that might be applied at every one of the plurality of keyhole locations. In this regard, a line of stitching has a very thin width. If stitching were to be reinforced by several overlying lines of stitching through the thickness of the part 100, such attempts at reinforcement are tempered by the structural damage that would be done to the part. Thus, even the best attempts at stitching the receptacle part 100 to the backpack do not provide the advantages of adhesive bonding, i.e., gluing or welding, and, further, with such stitching, the receptacle part 100 would risk flexing, which would provide an inferior connection of the associated shoulder strap.

In an alternative embodiment, not illustrated, the structures of the two elements 100, 101 of the adjustment mechanism could be reversed. That is, rather than having a receptacle part bonded to the backpack, an insert part could be bonded to the backpack, whereby an array of buttons—rather than an array of receptacles—would be presented for selective attachment to a receptacle part for each shoulder strap, each such part bearing a line of three receptacles. In such an embodiment, the entirety of the rear surface of the insert part could be a continuous solid surface, i.e., uninterrupted by through openings, e.g., which would be available for gluing or welding of the element to the backpack.

As shown in FIGS. 12 and 13, the left and right sections 100*a*, 100*b* of the receptacle part 100 diverge from a central parting line downwardly, by an angle relative to the other of approximately 30° from horizontal, although this is not limiting. The angle could be greater or less, and could be within a range of 15°-45°, for example, or even within a range of slightly greater than 0° to 45°. Alternatively, the sections 100*a*, 100*b* could be coextensive horizontally, whereby such angle would be 0°. The angling of the sections, however, is intended to provide for an ergonomically comfortable fit of the shoulder straps for the user.

In the illustrated embodiment, the receptacle part 100 has a width of approximately six inches, the height between the top and bottom edges of each section 100*a*, 100*b* is approximately three inches, and the thickness of the part 100 is approximately one-fourth of an inch, perhaps within a range of about 0.20-0.30 inches. These dimensions are not limiting; the width and height and can vary depending upon the range of adjustment that is to be afforded by the adjustment mechanism, as mentioned above, whereby a lesser or greater number of receptacles 102 could be provided, and the thickness can vary if, for example, one were to find that a thicker part 100 were advantageous in increasing rigidity of the adjustment mechanism.

FIG. 14 illustrates parts of the adjustment mechanism affixed to a backpack. More specifically, the receptacle part 100 is shown to be bonded to the back side 20 of a backpack, and an insert part 101 is shown to be affixed to the inner surface of the shoulder strap 106*b* on the right in FIG. 14 (i.e., for the user's left shoulder). On the left side of FIG. 14, the shoulder strap 106*a* for the user's right shoulder is shown already engaged to the backpack by means of an insert part, which is secured to the inner surface of strap 106*a* being engaged in section 100*a* of the receptacle part 100.

With further reference to FIGS. 12 and 14, the adjustment mechanism is further described with particular reference to the attachments of parts thereof to the inner surfaces of the shoulder straps 106*a*, 106*b*. FIG. 12 illustrates slot 107 and slot 108 on top and bottom ends, respectively, of the base 104 of the insert part 101. As shown in FIG. 14, these slots are used to anchor the insert part 101 to the inner surface of the shoulder strap. More specifically in this regard, a band of material 109 is provided, which is doubled upon itself to make a loop that extends through the slot 107, which band 109 is then affixed to the inner surface of the shoulder strap 106*b*. The attachment can be made by adhesive bonding, i.e., such as by gluing, and/or by means of stitching. In the example illustrated, one or more lines of stitching 110 can secure the band 109 to the shoulder strap adjacent the base 104 of the insert part, which defines the loop which extends through the slot 107. The band of material can be a plastic-reinforced fabric or other material having a suitable strength. In a similar manner, a band of material 111 is doubled upon itself to make a loop that extends through the slot 108 of the base 104 of the insert part 101, which band 111 is then affixed to the inner surface of the shoulder strap 106*b*.

Alternatively, rather than having slots 107, 108 and bands of material 109, 111, the scope of the invention encompasses creating the insert part 101 for each of the shoulder straps in the form of a plate that is bonded to respective ones of the inner surfaces of the shoulder straps, in the manner by which the receptacle part 100 is bonded to the back side of the backpack.

In addition to the receptacle part 100 and the insert part 101, the adjustment mechanism, particularly as embodied for use with a shoulder strap, can include a hook and loop fastener (i.e., such as a Velcro® fastener) for the lower ends of the shoulder straps. As shown in FIG. 14, such fastener can include the hook portions 113 of the fasteners glued or otherwise secured to the lower portions of the inner surfaces of the shoulder straps 106*a*, 106*b* and the loop portions 114 of the fasteners similarly secured to the back side of the backpack. In addition to the adjustment mechanism providing a wide range of easy adjustment for the shoulder straps, horizontally and vertically, by virtue of the elements 100, 101 thereof, such elements in combination with the hook and loop fasteners provide for the attachment of the shoulder straps to be very secure when closed in place.

FIG. 15 illustrates the back side 20 of the backpack in the area of the adjustment mechanism, with both shoulder straps 106*a*, 106*b* affixed in place by being attached to the receptacle part 100 of the adjustment mechanism and the ends of the straps being secured by the above-mentioned hook and loop fasteners. The adjustment mechanisms provides a range of adjustment for the attachment of the shoulder straps, in contrast with the fixed attachment of the ends 28*a* of the shoulder straps 26 shown in FIGS. 1-6.

The ends of the shoulder straps, in the illustrated embodiment of FIG. 15, are shown to have a relatively wide and contoured shape for comfort, which comfort is enhanced by the lower ends of the straps being padded by means of a relatively dense plastic foam material. Also for reasons of ergonomic comfort, FIG. 15 shows the portions 112*a*, 112*b* of the shoulder straps diverging from the adjustment mechanism, due to the relationship between the insert parts 101 and the receptacle part 100, as well as due to the diverging relationship of the sections 100*a*, 100*b* of the receptacle part.

The provision of the adjustment mechanism for the shoulder straps shown in FIGS. 12-15 give to the backpack so equipped versatility and comfort. Such comfort and versatility is further enhanced in a backpack shown in FIGS. 7 and 8, which additionally includes a comfort pad 80 and a rotatably affixed hip-belt 36. Further in this regard, the preferably plastic socket 84 of the pivotable connection mechanism 82, which is bonded to the back side 20 of the backpack against the frame 42, provides an advantageous counterpoint to the plastic receptacle plate 100 of the shoulder strap adjustment mechanism, the plate 100 being bonded to an upper part of the back side 20 of the backpack.

In the embodiments described above, the frame is adhesively bonded to the inner surface of the back side 20 of the pack 10. Nevertheless, as an alternative, it is also within the scope of the invention to provide that the frame be adhesively bonded to the outer surface. In such a case, from the perspective of facilitating the manufacture of the invention, at least part of the carrying system (and of other accessories) can be affixed to the frame instead of having them directly affixed to the backpack. Further, although the invention could be implemented as part of a backpack, frame, harness or other carried article, without a frame, if a frame is used, a part of the adjustment mechanism of the invention can be made part of the frame itself, as by injection molding.

In the above described embodiments, it has been chosen that the frame, the carrying system, and all other accessories are affixed to the pack portion by adhesive bonding. This is of course very interesting in terms of limiting or inhibiting water ingression into the backpack. Indeed, this drastically diminishes the number and the length of assembly stitches, which are always major water ingression points, unless waterproofed by additional means. This is of course desirable when the construction of a waterproof bag is pursued, because it eliminates the need to cover the corresponding stitches with a seam tape, saving both the additional weight of the tape and the extra manufacturing time. But it is also desirable in a conventional non-waterproof bag where non-waterproof fabrics are used. Indeed, by minimizing the major water ingression points, and by simply providing a water-repellent finish to the fabric, one can achieve a bag which is not waterproof, but which will nevertheless prevent major ingressions of water for a certain amount of time, which is often sufficient for ordinary uses.

FIGS. 16*a*-16*i* illustrate additional views of a backpack according to the invention, FIG. 16*a* being a view similar to that of FIG. 8, showing a pivotal hip-belt arrangement in combination with an adjustable shoulder strap mechanism, similar to that shown in FIGS. 12-15, mounted on the back side of the backpack.

FIGS. 17*a*-17*c* illustrate an alternative embodiment of mounting elements for an adjustable shoulder harness mechanism, which embodiment can be referred to as a "ladder rung adjustable shoulder harness system." FIG. 17*b* show the two elements separated, whereas FIGS. 17*a* and 17*c* show the second element of the adjustment mechanism engaged in one of an array of positions. The second element is in the form of a plastic hook that can be sewn or adhesively bonded, such as by gluing, to a shoulder strap using a webbing/fabric loop and can be positioned up and down and side-to-side on the rungs. The rung system can be a single piece or two separate pieces.

FIGS. 18*a*-18*d* illustrate another alternative embodiment of mounting elements of an adjustable shoulder harness mechanism, which embodiment can be referred to as a "dovetail adjustable shoulder harness system." In this system, a locking pin or snap-lock is used to fix the position side-to-side and a number of dovetail slots to allow for vertical adjustment.

FIGS. 19*a*-19*c* illustrate another alternative embodiment of mounting elements of an adjustable shoulder harness mechanism, which embodiment could also be referred to as a "dovetail adjustable shoulder harness system," which includes a glue-mount to a shoulder strap. That is, the element of the mechanism that attaches to the shoulder strap is adhesively bonded, such as by gluing, directly rather than being fixed with a webbing or fabric loop. This style of attachment could be used on any of the other aforementioned systems as well. All of the systems are adaptable, according to the invention, to be adhesively bonded onto the bag.

The present invention is not limited to the particular embodiments hereinabove described by way of non-limiting examples, but encompasses all similar or equivalent embodiments.

Further, as mentioned above, although the invention has been described and illustrated with reference to a bag in the form of a backpack, the invention encompasses articles and bags of different types, such as duffle bags, drybags, travelpacks, e.g., having an adjustable positioning mechanism for a carrying member, i.e., such as a strap or other item releasably attached to a surface of such article or bag at any of a range of attachment locations along the length and width of such surface of the article or bag. In such embodiments, the articles and bags may include a rigidifying frame, which can be particularly beneficial for a backpack, as described above, or have no rigidifying frame.

The invention claimed is:

1. An article to be carried comprising:

a wall having a height and a width, the wall having an internal side and an external side;

a rigidifying frame connected to the internal side of the wall of the article by an adhesive bond to create a layered subassembly, the wall extending widthwise beyond the layered subassembly at at least a portion of the height of the wall;

the rigidifying frame includes a sheet of elastic foam and a rigid or semi-rigid sheet;

an adjustable positioning mechanism for removably connecting a carrying strap to the layered subassembly on the external side of the wall, the mechanism providing a range of attachment locations for the carrying strap in relation to the layered subassembly, to achieve an optimum ergonomic position of the carrying strap at one of the attachment locations, said adjustable positioning mechanism comprising:

a first element affixed by an adhesive bond to the layered subassembly of the article to be carried;

the first element comprising an array of first connector sites, such array comprising a plurality of rows and a plurality of columns providing adjustability along said layered subassembly in both a first direction and a second direction, the second direction being transverse to the first direction;

the adhesive bond affixing the first element to the layered subassembly being at least at a location, in relation to the layered subassembly, an equal distance from a reference point as a location of the adhesive bond between the rigidifying frame and the wall, such that a laminate structure is created that includes the first element, the rigidifying frame, the wall, and the adhesive bonds;

a second element structured and arranged to be connected to the carrying strap to be connected to the article, the second element including at least two second connector sites for selective releasable fixed engagement with respective ones of at least two of said array of first connector sites of the first element, so that the first and second elements are connected together by way of a plurality of first connector sites and a plurality of second connector sites;

the array of first connector sites comprising an array of key-hole shaped receptacles and said second connector sites comprise a plurality of projections, each of said projections being structured and arranged to be receivable within a respective one of the receptacles of said array;

the array of key-hole shaped receptacles comprising a plurality of distinct openings, each opening of the plurality of openings having a closed periphery.

2. An article to be carried according to claim 1, wherein:

adjustability along a first direction and along a second direction transverse to the first direction comprises adjustability in horizontal and vertical directions.

3. An article to be carried according to claim 1, wherein:

the array of receptacles comprises straight rows of receptacles.

4. An article to be carried according to claim 1, wherein:

said array of first connector sites of said first element of the adjustable positioning mechanism comprises an array of receptacles and said second connector sites of said second element of the adjustable positioning mechanism comprise projections, each of said receptacles being structured and arranged to become releasably fixedly engaged with a respective one of said projections by lateral movement of said respective one of said projections in only a single lateral direction along a facing surface of the first element; or said array of first connector sites of said first element of the adjustable positioning mechanism comprises an array of projections and said second connector sites of said second element of the adjustable positioning mechanism comprise receptacles releasably fixedly engageable with said projections, each of said receptacles being structured and arranged to become releasably fixedly engaged with a respective one of said projections by lateral movement of said respective one of said projections in only a single lateral direction along a facing surface of the second element.

5. An article to be carried according to claim 1, wherein:

the second connector sites are structured and arranged to be moved from disengagement with the first element of the adjustable positioning mechanism to engagement with the first element and into a removably fixed position with the first connector sites by only a sliding in a single direction.

6. An article to be carried according to claim 1, wherein:

the second element comprises a one-piece base or frame for the at least two second connector sites.

7. An article to be carried according to claim 1, wherein:

the array of receptacles comprises a first set of straight rows of receptacles and a second set of straight rows of receptacles;

the first and second sets of receptacles are laterally offset and the rows of receptacles of the first set extend downwardly and laterally away at an angle from the rows of receptacles of the second set.

8. An article to be carried according to claim 7, wherein:

the angle is within a range of 15° to 45°.

9. An article to be carried according to claim 1, wherein:

said first element comprises, in one plastic piece, a frame and said first connector sites.

10. An article to be carried according to claim 9, wherein:

said second element comprises, in one plastic piece, a frame and said second connector sites.

11. An article to be carried according to claim 1, wherein:

the array of first connector sites comprises:

a first plurality of rows of first connector sites extending in a first direction;

a second plurality of rows of first connector sites extending in a second direction;

the first direction and the second direction intersecting at an acute angle.

12. An article to be carried according to claim 11, wherein:

in a carried position of the article, the acute angle forms an inverted V-shape.

13. An article to be carried according to claim 1, wherein:

the adhesive bond affixing the first element to the layered subassembly and the adhesive bond between the rigidifying frame and the wall both comprise a thermo-activated glue or glue-containing compound.

14. An article to be carried according to claim 13, wherein:

said second element comprises, in one plastic piece, a frame and said second connector sites.

15. A bag or pack comprising:

a pack portion including a back side made of flexible material;

a rigidifying frame within the pack portion, the rigidifying frame connected to the back side of the pack portion by an adhesive bond, the rigidifying frame comprising:

a sheet of elastic foam;

a rigid or semi-rigid sheet;

a carrying system directly or indirectly connected to the pack portion and comprising at least one carrying member having at least two spaced-apart portions connected to respective spaced-apart portions of the pack portion;

an adjustment mechanism for providing a range of adjustable attachment locations on the pack portion for the carrying member at at least one of said two spaced-apart portions of the pack portion;

the adjustment mechanism comprising:

a first element affixed by an adhesive bond at one of said two spaced-apart portions of the pack portion by being glued or welded to the pack portion, the first element comprising a plurality of first connector sites;

a second element affixed to the carrying member, the second element of the adjustment mechanism comprising at least two second connector sites for selective releasable fixed engagement with a pair of the plurality of first connector sites of the first element of the adjustment mechanism;

the adhesive bond affixing the first element at least at a location, in relation to the pack portion, an equal distance from a reference point as a location of the adhesive bond between the rigidifying frame and the pack portion.

16. A bag or pack according to claim 15, wherein:

the rigidifying frame comprises a rigid or semi-rigid frame affixed to the back side of the pack portion by adhesive bonding.

17. A bag or pack according to claim 15, wherein:

the carrying member comprises a shoulder strap and at least one of the spaced-apart portions of the pack portion is in a shoulder region.

18. A bag or pack according to claim 15, wherein:

the plurality of connector sites of the first element comprises an array of first connector sites;

the first element of the adjustment mechanism comprises a plastic plate, the plastic plate including the array of first connector sites, such array including a plurality of differently vertically positioned laterally extending rows of first connector sites, providing horizontal and vertical adjustability.

19. A bag or pack according to claim 15, wherein:

the second connector sites are structured and arranged to be moved from disengagement with the first element of the adjustable positioning mechanism to engagement with the first element and into a removably fixed position with the first connector sites by only a sliding in a single direction.

20. A bag or pack according to claim 15, wherein:

the second element comprises a one-piece base or frame for the at least two second connector sites.

21. A bag or pack according to claim 15, wherein:

the rigidifying frame is adhesively bonded to an inner surface of the back side of the pack portion of the bag or pack.

22. A bag or pack according to claim 15, wherein:

the plurality of first connector sites of the first element are structured to provide adjustability in both a first direction and a second direction, the second direction intersecting with the first direction.

23. A bag or pack according to claim 15, wherein:

the plurality of first connector sites comprise an array of first connector sites;

the array of first connector sites comprises a plurality of rows of first connector sites and a plurality of columns of first connector sites.

24. A bag or pack according to claim 15, wherein:

the back side of the pack portion has a height and a width;

the rigidifying frame, adhesive bond, and back side of the pack portion create a layered subassembly;

the back side of the pack portion extends widthwise beyond the layered subassembly at at least a portion of the height of the back side of the pack portion.

25. A bag or pack according to claim 15, wherein:

the plurality of first connector sites of the first element comprises an array of first connector sites;

the array of first connector sites comprises:

a first plurality of rows of first connector sites extending in a first direction, both laterally and upwardly, in a carried position of the bag or pack;

a second plurality of rows of first connector sites extending in a second direction, both laterally and upwardly, in the carried position of the bag or pack;

the first direction and the second direction intersecting at an acute angle.

26. A bag or pack according to claim 25, wherein:

the acute angle forms an inverted V-shape in the carried position of the bag or pack.

27. A bag or pack according to claim 15, wherein:

the adhesive bond affixing the first element in relation to the pack portion and the adhesive bond between the rigidifying frame and the pack portion both comprise a thermo-activated glue or glue-containing compound.

28. A bag or pack according to claim 27, wherein:

the second element comprises a one-piece base or frame for the at least two second connector sites.

29. A bag or pack according to claim 15, wherein:

the bag or pack is a backpack;

the carrying system of the backpack includes a pair of shoulder straps, each shoulder strap including a respective second element of an adjustment mechanism for providing independent adjustment in relation to the other shoulder strap.

30. A bag or pack according to claim 29, further comprising:

a hip-belt and a pivoting connection mechanism for pivotally connecting the hip-belt to the back side of the pack portion of the backpack;

the pivoting connection mechanism including at least a first element adhesively bonded to the back side of the pack portion of the backpack.

31. A bag or pack according to claim 30, wherein:

the first element of the adjustment mechanism and the first element of the pivoting connection mechanism being adhesively bonded to the back side of the pack portion of the backpack against the rigidifying frame.

32. A bag or pack comprising:

a pack portion including a back side made of flexible material;

a rigidifying frame within the pack portion, the rigidifying frame connected to the back side of the pack portion by an adhesive bond, the rigidifying frame comprising:

a sheet of elastic foam;

a rigid or semi-rigid sheet;

a carrying system directly or indirectly connected to the pack portion and comprising at least one carrying member having at least two spaced-apart portions connected to respective spaced-apart portions of the pack portion;

an adjustment mechanism for providing a range of adjustable attachment locations on the pack portion for the carrying member at at least one of said two spaced-apart portions of the pack portion;

the adjustment mechanism comprising:

a first element affixed by adhesive bond at one of said two spaced-apart portions of the pack portion by being glued or welded to the pack;

a second element affixed to the carrying member;

the first element of the adjustment mechanism including a plurality of first connector sites and the second element includes a plurality of second connector sites;

the first connector sites being releasably fixedly engageable with the second connector sites for providing the aforementioned range of attachment locations for the carrying member by enabling a selectively releasable fixed connection of the second element of the adjustment mechanism to the first element of the adjustment mechanism in any of a plurality of different attachment locations of the carrying member in relation to the pack portion of the pack.

33. A bag or pack according to claim 32, wherein:

at least one of the pluralities of first and second connector sites includes a plurality of connector sites that enable a selective removably fixed connection of the second element of the adjustment mechanism along a range of different horizontally and/or vertically spaced-apart attachment locations.

34. A bag or pack according to claim 32, wherein:

the plurality of first connector sites comprises a plurality of receptacles and the plurality of second connector sites comprises a plurality of projections, each said projection being structured and arranged to be receivable within a respective one of the receptacles;

the plurality of receptacles comprises a plurality of distinct openings, each opening of the plurality of openings having a closed periphery.

35. A bag or pack according to claim 32, wherein:

said plurality of first connector sites of the first element of the adjustment mechanism comprises a plurality receptacles and the plurality of second connector sites of the second element of the adjustment mechanism comprises projections, each of said receptacles being structured and arranged to become releasably fixedly engaged with a respective one of the projections by lateral movement of said respective one of the projections in only a single lateral direction along a facing surface of the first element; or said plurality of first connector sites of the first element of the adjustment mechanism comprises a plurality of projections and the plurality of second connector sites of the second element of the adjustment mechanism comprises receptacles, each of said receptacles being structured and arranged to become releasably fixedly engaged with a respective one of the projections by lateral movement of said respective one of the projections in only a single lateral direction along a facing surface of the second element.

36. A bag or pack according to claim 32, wherein:

the adhesive bond affixing the first element at a location, in relation to the pack portion, corresponds to a location of adhesive between the rigidifying frame and the pack portion.

37. A bag or pack according to claim 32, wherein:

the second connector sites are structured and arranged to be moved from disengagement with the first element of the adjustable positioning mechanism to engagement with the first element and into a removably fixed position with the first connector sites by only a sliding in a single direction.

38. A bag or pack according to claim 32, wherein:

the second element comprises a one-piece base or frame for the at least two second connector sites.

39. A bag or pack according to claim 32, wherein:

the rigidifying frame is adhesively bonded to an inner surface of the back side of the pack portion of the bag or pack.

40. A bag or pack according to claim 32, wherein:

the plurality of first connector sites of the first element are structured to provide adjustability in both a first direction and a second direction, the second direction intersecting with the first direction.

41. A bag or pack according to claim 32, wherein:

the plurality of first connector sites comprise an array of first connector sites;

the array of first connector sites comprises a plurality of rows of first connector sites and a plurality of columns of first connector sites.

42. A bag or pack according to claim 32, wherein:

the back side of the pack portion has a height and a width;

the rigidifying frame, adhesive bond, and back side of the pack portion create a layered subassembly;

the back side of the pack portion extends widthwise beyond the layered subassembly at at least a portion of the height of the back side of the pack portion.

43. A bag or pack according to claim 32, wherein:

the plurality of first connector sites of the first element comprises an array of first connector sites;

the array of first connector sites comprises:

a first plurality of rows of first connector sites extending in a first direction, both laterally and upwardly, in a carried position of the bag or pack;

a second plurality of rows of first connector sites extending in a second direction, both laterally and upwardly, in the carried position of the bag or pack;

the first direction and the second direction intersecting at an acute angle.

44. A bag or pack according to claim 43, wherein:

the acute angle forms an inverted V-shape in the carried position of the bag or pack.

45. A bag or pack according to claim 32, wherein:

the adhesive bond between the first element of the adjustment mechanism and the pack portion is at a location an equal distance from a reference point as a location of the adhesive bond between the rigidifying frame and the back side of the pack portion, so as to create a laminate structure that includes the first element, the rigidifying frame, the back side of the pack portion, and the adhesive bonds.

46. A bag or pack according to claim 45, wherein:

the adhesive bond between the first element of the adjusting mechanism and the pack portion and the adhesive bond between the rigidifying frame and the back side of the pack portion both comprise a thermo-activated glue or glue-containing compound.

47. A bag or pack according to claim 46, wherein:

said second element comprises, in one plastic piece, a frame and said second connector sites.

48. A bag or pack according to claim 32, wherein:

said plurality of first connector sites of said first element of the adjustment mechanism comprises receptacles and said plurality of second connector sites of said second element of the adjustment mechanism comprises projections which are releasably fixedly engageable with said receptacles; or said plurality of first connector sites of said first element of the adjustment mechanism comprises projections and said plurality of second connector sites of said second element of the adjustment mechanism comprises receptacles which are releasably fixedly engageable with said projections.

49. A bag or pack according to claim 48, wherein:

said plurality of first connector sites is greater in number than said plurality of second connector sites, whereby the carrying member can be moved from a first of the at least two spaced-apart connection locations to a second of the at least two spaced-apart connection locations by disengaging projections of said second element from receptacles of said first element at said first of the at least two spaced-apart connection locations and by engaging projections of said second element with receptacles of said first element at said second of the at least two spaced-apart connection locations.

50. A bag or pack according to claim 48, wherein:

said first element comprises, in one plastic piece, a frame and said first connector sites.

51. A bag or pack according to claim 48, wherein:

said second element comprises, in one plastic piece, a frame and said second connector sites.

52. A bag or pack according to claim 48, wherein:

said receptacles are keyhole-shaped receptacles and said projections are button-headed projections.

53. A bag or pack according to claim 52, wherein:

the button-headed projections include respective stems;

the narrowed portions of respective receptacles of the array of receptacles are shaped to provide respective protuberances to provide firm engagement with the projections to facilitation retention of the projections in the receptacles.

54. A bag or pack according to claim 52, wherein:

a receptacle of said keyhole-shaped receptacles comprising an enlarged portion and a narrowed portion extending from said enlarged portion;

a button of said button-headed projections having a size and shape to be freely received and removed from said enlarged portion of said receptacle and to be retained beneath said narrowed portion of said receptacle.

55. A bag or pack according to claim 54, wherein:

the bag or pack is a backpack; and the carrying member comprises at least one shoulder strap;

the narrowed portion of the receptacle extends upwardly in a direction toward a top of the backpack from said enlarged portion of the receptacle.

* * * * *